US010493471B2

(12) United States Patent
Eurippini

(10) Patent No.: US 10,493,471 B2
(45) Date of Patent: Dec. 3, 2019

(54) SPRAYING DEVICE FOR A PRODUCT

(71) Applicant: L'OREAL, Paris (FR)

(72) Inventor: Cécile Eurippini, Levallois-perret (FR)

(73) Assignee: L'OREAL, Paris (FR)

( * ) Notice: Subject to any disclaimer, the term of this patent is extended or adjusted under 35 U.S.C. 154(b) by 0 days.

(21) Appl. No.: 15/753,098

(22) PCT Filed: Sep. 2, 2016

(86) PCT No.: PCT/EP2016/070784
§ 371 (c)(1),
(2) Date: Feb. 15, 2018

(87) PCT Pub. No.: WO2017/037269
PCT Pub. Date: Mar. 9, 2017

(65) Prior Publication Data

US 2018/0243763 A1 Aug. 30, 2018

(30) Foreign Application Priority Data

Sep. 4, 2015 (FR) ..... 15 58233
Sep. 4, 2015 (FR) ..... 15 58235
(Continued)

(51) Int. Cl.
*B05B 1/14* (2006.01)
*B65D 83/20* (2006.01)
(Continued)

(52) U.S. Cl.
CPC ..... *B05B 1/14* (2013.01); *A45D 19/02* (2013.01); *A45D 33/02* (2013.01); *A45D 34/04* (2013.01);
(Continued)

(58) Field of Classification Search
CPC ..... B05B 1/14
(Continued)

(56) References Cited

U.S. PATENT DOCUMENTS 2,933,259 A * 4/1960 Raskin ..... B05B 7/04 239/405
3,767,125 A * 10/1973 Gehres ..... B05B 1/14 239/552
(Continued)

FOREIGN PATENT DOCUMENTS

EP 0452208 A1 10/1991
EP 1688368 A1 8/2006
(Continued)

OTHER PUBLICATIONS

EP0452208 with Machine Translation.*
Japan Patent Office, Office Action (dated Apr. 17, 2019), (Japanese Application 2018-510438).

*Primary Examiner* — Vishal Pancholi
(74) *Attorney, Agent, or Firm* — McNees Wallace & Nurick LLC

(57) ABSTRACT

The present invention relates to a device for spraying a product, in particular a cosmetic product, makeup product or care product, said device comprising:

Figure 1:
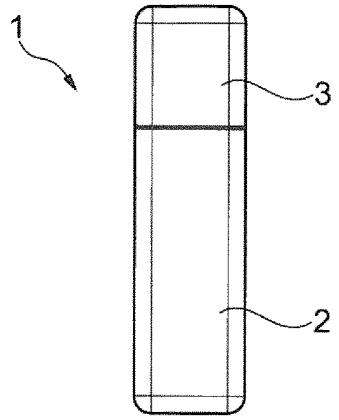

a container containing the product, and a dispensing head (3) comprising a body (5), and an endpiece, in particular a diffuser (7), attached to the body, the body and the endpiece (7) being configured to allow the product to be sprayed through outlet orifices about a longitudinal axis (Y) of the endpiece, in particular in at least two different directions, which are in particular diametrically opposite, the dispensing head (3) comprising at least first (15) and second (16) chambers, in particular concentric chambers, through which the flow of product successively passes before emerging from the outlet orifices, at least one opening between the first and second concentric chambers being able to be offset angularly with respect to at least one of the outlet orifices.

20 Claims, 10 Drawing Sheets

(30) Foreign Application Priority Data

Sep. 4, 2015 (FR) ..... 15 58236
Sep. 4, 2015 (FR) ..... 15 58238
Sep. 4, 2015 (FR) ..... 15 58241

(51) Int. Cl.

| | |
|---|---|
| ***B65D 83/28*** | (2006.01) |
| ***B65D 83/40*** | (2006.01) |
| ***B65D 83/46*** | (2006.01) |
| ***A45D 19/02*** | (2006.01) |
| ***A45D 33/02*** | (2006.01) |
| ***A45D 34/04*** | (2006.01) |

(52) U.S. Cl.
CPC ..... *B65D 83/205* (2013.01); *B65D 83/28* (2013.01); *B65D 83/40* (2013.01); *B65D 83/46* (2013.01); *A45D 2200/10* (2013.01)

(58) Field of Classification Search
USPC ..... 222/135, 145, 148, 190, 330, 394, 222/402.13, 464, 510, 531
See application file for complete search history.

(56) References Cited

U.S. PATENT DOCUMENTS 4,239,407 A 12/1980 Knight
5,249,747 A * 10/1993 Hanson ..... B65D 83/753 239/373
5,730,332 A * 3/1998 Zimmerhackel ..... B05B 7/0068 222/148
5,813,785 A * 9/1998 Baudin ..... B65D 83/285 401/190
6,158,674 A * 12/2000 Humphreys ..... B05B 1/14 222/321.6
6,158,675 A 12/2000 Ogi
RE38,023 E * 3/2003 De Laforcade ..... B05B 1/26 222/402.1
6,824,077 B2 * 11/2004 De Laforcade ..... B05B 1/26 239/333
7,234,651 B2 6/2007 Mousavi et al.
7,497,635 B1 3/2009 Bae
8,191,802 B2 * 6/2012 Khan ..... B05B 1/14 239/548
2002/0017575 A1 2/2002 Andrews et al.
2012/0234947 A1 9/2012 Takahashi
2013/0192593 A1 * 8/2013 Jung ..... A61M 11/00 128/200.14
2015/0122833 A1 * 5/2015 Baudin ..... A45D 34/00 222/1
2015/0313662 A1 * 11/2015 Ottanelli ..... A61B 18/0218 606/25

FOREIGN PATENT DOCUMENTS

FR 2827528 A1 1/2003
GB 2340891 A 3/2000
JP S48-49577 A 7/1973
JP 02-238914 A 9/1990
JP 2003326197 A 11/2003
WO 2011065413 A1 10/2012

* cited by examiner

SPRAYING DEVICE FOR A PRODUCT

The present invention relates to packaging and dispensing devices comprising a container containing the product to be dispensed, in particular devices for spraying a product, and more particularly those comprising a pressurized container which contains the product to be dispensed and which is equipped with a valve. The product can be a cosmetic product, makeup product or care product, for example a product for the hair or for the scalp, for example a lacquer, a volumizing product or styling product. The product can be a fluid or a gas. It can be dry, being for example a powder, or a gel or a mousse. It can be a shampoo or an alcohol-containing composition. The product can also be a care product for the nostrils, for example. The product can also be a food product or household product. The product is preferably cosmetic.

The invention relates more particularly to applying a product in a confined space, for example in the hair mass near the scalp, or in the nostrils, or for applying food inside a dish.

The application U.S. 2002/0017575 discloses a spray device comprising one or more spray stems pierced with orifices allowing a product to be dispensed in the hair.

The U.S. Pat. No. 4,239,407 likewise discloses a device for spraying wax, said device comprising a cone-shaped dispensing nozzle with orifices distributed on the conical wall of the nozzle.

The U.S. Pat. Nos. 7,234,651 and 6,158,675 relate to devices for dispensing irrigation water onto surrounding vegetation, in which devices the water can be delivered from several points on the periphery of the nozzle.

The U.S. Pat. No. 7,497,635 relates to a device for spraying a cosmetic product, said device comprising a massage head with a substantially spherical shape.

The application FR 2 827 528 relates to a dispensing head comprising two outlet nozzles which are convergent.

Dispensing Head with Two Chambers

According to a first of its aspects, the invention relates to a device for spraying a product, in particular a cosmetic product, makeup product or care product, said device comprising:

a container containing the product, and a dispensing head comprising a body, and an endpiece, in particular a diffuser, attached to the body, the body and the diffuser being configured to allow the product to be sprayed through outlet orifices about a longitudinal axis Y of the endpiece, in particular in at least two different directions, which are in particular diametrically opposite, the dispensing head comprising at least first and second chambers, in particular concentric chambers, through which the flow of product successively passes before emerging from the outlet orifices, at least one opening between the first and second concentric chambers being able to be offset angularly with respect to at least one of the outlet orifices. This angular offset is to be understood as being an offset about the axis of the concentric chambers or about the axis of the device, for example.

Thus, the flow of product emerging from the diffuser has in particular undergone at least two changes of direction of the flow in the diffuser, or even at least three changes of direction. "Change of direction" is to be understood as meaning that the flow of product passes from a first direction to a second direction, the two directions forming between them an angle preferably greater than 60°, or greater than 90°, preferably greater than 120°, or greater than 150°. In one illustrative embodiment, the flow of product undergoes at least one change of direction of greater than 120°, or greater than 150°, preferably of the order of 180°.

The spray device according to the invention permits targeted delivery, for example to the hair roots, and permits good spraying at the base of the hairs. The spraying of the product in at least two different directions makes it possible to reach areas situated around the dispensing head and to widen the delivery.

The changes of direction of the flow of product in the diffuser permit the creation of turbulence in the flow of product, thereby helping to reduce the size of the droplets or blobs of product. It is possible to obtain a gentler jet and to create a drop in pressure that promotes the comfort of the application.

The device according to the invention is particularly suitable for the delivery of powders containing fine particles and is able to prevent blockage of the dispensing orifices.

The outlet orifices do not open directly into the first inner chamber.

When assembled, the body and the endpiece can define several outlet orifices about a longitudinal axis Y of the endpiece, in particular in at least two different directions, which are in particular diametrically opposite. Alternatively, the dispensing orifices can be formed directly in the diffuser. They can be formed in a curved portion of the diffuser, for example a portion with a hemispherical shape.

The use of the word "endpiece" does not exclude the possibility that the endpiece can comprise an attached element defining the end of the dispensing head.

The dispensing head can comprise just two components, namely the body and the endpiece, in particular the diffuser, that are mentioned above. The dispensing head can be without a third component separate from these.

The first chamber and second chamber can be at least partially annular, in particular cylindrical. The first at least partially annular chamber can extend along the longitudinal axis Y and be inclined with respect to a longitudinal axis X of the device by a non-zero angle $\gamma$. The second at least partially annular chamber can extend along the longitudinal axis Y and be inclined with respect to a longitudinal axis X of the device by a non-zero angle $\gamma$.

The concentric chambers can be at least partially annular or, indeed, annular. The dispensing head can in particular comprise a first inner chamber and a second outer chamber. The inner and outer chambers can be separated by a separation skirt. This skirt is able to ensure the leaktightness of the chambers.

This separation skirt can be pierced with at least one opening, or at least two openings, allowing the flow of product to pass through. Thus, the flow of product can be separated into at least two distinct streams. The openings in the separation skirt can be distributed uniformly on the circumference of the separation skirt. For example, they can be diametrically opposite when they are two in number. Their number can be an even number, in particular between 2 and 10, for example 2, 4, 6 or 8. The openings can extend along the entire height of the separation skirt or along only part thereof. The height of the separation skirt can be between 0.2 and 6 mm, or between 1 and 5 mm, for example of the order of 1.9 or 4 mm.

The second chamber can be surrounded by a peripheral skirt cooperating with the body in such a way as to ensure the closure of the second chamber. The outlet orifices can be distributed uniformly on the circumference of the peripheral skirt. For example, they are diametrically opposite when they are two in number. Their number can be an even number, in particular between 2 and 10, for example 2, 4, 6 or 8. They can be diametrically opposite in respective pairs. Such an arrangement of the outlet orifices may be able to lift the hair and promote distribution of the product over the whole scalp.

The dispensing head can be configured to permit spraying of the product through outlet orifices in at least one direction transverse to a longitudinal axis Y, in particular in at least two different directions, which are in particular diametrically opposite.

The outlet orifices can be coplanar and arranged in an inclined plane with respect to the longitudinal axis X. The dispensing head can comprise in particular at least three coplanar outlet orifices, the directions of spraying being in particular arranged at at least 30°, or at least 60°, or at least 90° from each other.

The outlet orifices can extend along the entire height of the peripheral skirt or along only part thereof. This height of the peripheral skirt can be between 0.2 and 8 mm, or between 1 and 6 mm, for example of the order of 1.9 or 5 mm.

The outlet orifices can be offset angularly with respect to the opening(s) of the separation skirt, each by an angle of between 0 and 180°, preferably between 20 and 90°, preferably between 30 and 80°, for example of the order of 45°.

The body can comprise an annular groove intended to receive the peripheral skirt of the diffuser. The annular groove is able to permit a continuous flow and a good supply to the orifices.

The body can have two concentric and continuous annular ribs between which, in particular, the peripheral skirt of the diffuser is able to engage, in which skirt the outlet orifices can be formed. Thus, the annular groove can be delimited by the two concentric ribs, which are symmetrical in revolution about the longitudinal axis Y of the body and are configured to engage on each side of the peripheral skirt. The ribs can bear against shoulders present on the separation skirt and peripheral skirt, respectively. For example, the ribs each have a thickness $e_1$ and $e_2$ of between 0.2 and 2 mm, or between 0.5 and 1.5 mm, preferably between 0.6 and 1 mm.

The longitudinal axis Y of the diffuser can constitute an axis of symmetry of the diffuser.

The diffuser is preferably joined to the body at the top of the latter.

The diffuser can define the upper axial end of the dispensing head.

The endpiece, in particular the diffuser, can comprise an upper face of a generally curved shape with an outward convexity. The radius of curvature of this face can generally be between 0 and 20 mm, or between 2 and 10 mm, preferably between 3 and 9 mm, for example of the order of 6 mm.

The upper face of the diffuser can comprise markers which indicate the direction of discharge of the jets. For example, these markers are reliefs with the general shape of a triangle, of which the point is oriented towards the edge of the upper face and towards the peripheral skirt.

The upper face of the diffuser can have a central depression with a circular contour. This central depression is able to accommodate an injection sprue, in such a way as to avoid injury to the skin.

The body and the diffuser can be joined together in particular by welding, for example by ultrasound. They can also be joined together in another way, for example by adhesive bonding. In this case, they are moulded separately before being joined. Alternatively, they are moulded in one piece, being connected to each other by a film hinge, for example, during the moulding.

The dispensing head can have a supply channel for the product coming from the container. For this purpose, the body comprises a central channel intended to allow the flow of product to pass from the container to the diffuser. The body can define a cannula through which said channel extends, this cannula having a longitudinal axis inclined with respect to the longitudinal axis X of the container.

The central channel of the body can comprise a vertical portion, which extends in the longitudinal axis X of the device above the container, and an oblique portion, which is inclined by an angle γ with respect to the vertical portion. The angle γ can be between 0 and 90°, preferably between 5 and 40°, or between 10 and 30°, for example of the order of 15°. The oblique portion of the central channel can receive the diffuser. The annular groove and the abovementioned ribs of the body are arranged at an end of the body opposite a part for fixing the dispensing head on the container.

The vertical portion of the central channel is intended to receive the stem of the dispensing valve of the container.

The diffuser can be solid in the area of its longitudinal axis. The endpiece, in particular the diffuser, can comprise a stem allowing it to be fixed to the body, in particular by being inserted into the central channel of the body. It can be fixed by being inserted by force, with or without at least one fixation relief, for example a harpoon, and/or by snap-fit engagement. For this purpose, the stem can comprise a fixation relief intended to cooperate with a corresponding relief of the body. In one illustrative embodiment, the stem can comprise two partially annular notches, diametrically opposite each other, as fixation reliefs. The body can comprise an annular groove in order to receive an annular fixation bead protruding from the stem. The stem of the diffuser can have a harpoon shape.

The stem of the diffuser can constitute the sole means of fixing the diffuser on the body. The stem can be attached at the top to a dome-shaped wall which defines the aforementioned upper face of generally curved shape.

The stem of the diffuser can comprise at least one groove defining a passage for product from the channel to the diffuser, preferably two diametrically opposite grooves which each define a passage for product from the channel to the endpiece, in particular the diffuser. In cross section, said grooves can have a contour in the shape of a segment of a circle. The grooves can extend between said notches mentioned above. Said one or more grooves are formed by a reinforcement extending along the stem of the diffuser. Their number can be an even number, in particular between 2 and 10, for example 2, 4, 6 or 8.

Alternatively, the dispensing head can be without such a stem. For example, the endpiece can be fixed to the body via its circumference.

In one variant, the device comprises at least one orifice allowing the product to pass from the body towards the diffuser. The device can comprise at least two orifices, which are two in number, for example, and diametrically opposite.

An indexing means can be used in order to allow the diffuser to be mounted on the body in a specified manner.

The device can be without a nozzle having swirl ducts, which fact simplifies its production. The dispensing orifices can preferably lead directly to the outside, without an attached nozzle. An attached nozzle is understood as a component having at least one outlet orifice and comprising a plane wall in which the outlet orifice is formed, and also a mounting skirt, which can be mounted on a centre post.

The container can be pressurized. The container can in particular be an aerosol system delivering droplets of a product which is propelled by a propellant gas, liquefied or non-liquefied, comprising an alcohol solution or aqueous solution, and also, for example, polymer resins which, upon drying, form fine connections between the hairs. The product can be mixed with the propellant gas or be contained in a flexible bag surrounded by the propellant gas.

The container may or may not be refillable.

The device can comprise a closure cap intended to cover the body and the diffuser.

The dispensing head can be arranged so as to allow the protective cap to be fitted and can comprise, if need be, an on/off system that makes it possible to prevent the actuation of the device when the dispensing head is in a certain position with respect to the container or when a locking element of the dispensing head is in a certain position in relation to the latter.

Each jet emerging from the diffuser can be oriented generally along an axis not parallel to a longitudinal axis X of the device, in particular obliquely, for example being inclined with respect to the longitudinal axis of the device by an angle greater than 10°, preferably greater than 20°, more preferably greater than 30°. The puff of the product emerging from an orifice can be utilized to lift the hairs, which promotes the application of the product to the scalp through other outlet orifices.

The flow emerging from each outlet orifice can be oriented perpendicularly with respect to the axis Y of the diffuser, the outlet orifices being coplanar, for example, and having axes oriented perpendicularly with respect to the axis Y of the diffuser. Alternatively, the jet emerging from each outlet orifice can form an angle with the normal to this axis Y, in such a way that all the jets produce a resulting spray of substantially conical shape. This angle can be a non-zero angle, between 5 and 180°, preferably between 10 and 90°, or between 20 and 80°, preferably between 25 and 70°, for example of the order of 35°.

The device can comprise at least three outlet orifices, which are preferably not aligned. The distance between the farthest outlet orifices can be less than 25 mm, preferably less than 20 mm, or less than 15 mm, for example of the order of 12 mm or 10 mm.

The dispensing of the product can be triggered by tilting the body with respect to the container. For this purpose, the body can comprise a bearing surface for the user's finger, said bearing surface being defined by a wall which, for example, is connected by a hinge to the part for fixing on the container.

The invention further relates to a cosmetic treatment process comprising the following steps:

making available a device as described above, placing at least part of the dispensing head, in particular the diffuser, under the hair.

The invention further relates to the use of the device as described above for spraying a product through 360°.

Dispensing Head with an Inner Wall for Splitting a Jet

It is known for products, in particular cosmetic products, to be packaged in pressurized containers. The latter are equipped with dispensing heads defining one or more dispensing orifices through which the product can be dispensed in the form of a spray or sprays. The particle size of the spray droplets depends in particular on the product flowrate, the pressure and the size of the one or more dispensing orifices.

It is customary to use dispensing heads equipped with attached nozzles, in particular with swirl ducts. Such nozzles comprise a wall which, at its centre, has a dispensing orifice passing through it and which, at its periphery, is provided with a tubular mounting skirt. The nozzle is mounted on a peg, also called a centre post, of which the end is positioned generally in contact with the inner face of said wall. Channels are formed on the end of the peg in order to allow the product to reach the dispensing orifice. Given the small space existing between the opposing faces of the nozzle and of the peg, a significant pressure drop can be created so as to lower the pressure and obtain an acceptable spray.

The disadvantage of such dispensing heads is their cost, since the one or more attached nozzles constitute a supplementary component that complicates the manufacture of the head.

There is therefore a need to make the manufacture of the dispensing heads easier while at the same time obtaining acceptable spray characteristics.

According to another of its aspects, the invention relates to a device for spraying a product, in particular a cosmetic product, makeup product or care product, said device comprising:

a container containing the product, and a dispensing head comprising a body with a supply channel for the product coming from the container, and an endpiece, in particular a diffuser, defining several outlet orifices for the product, the distance between the farthest outlet orifices being less than 25 mm, preferably less than 20 mm, or less than 15 mm, the dispensing head comprising at least one inner wall for splitting a jet, which is different from a wall defining the end of the supply channel for the product in the endpiece.

"Inner wall" designates a wall internal to the dispensing head, which wall defines, on each side, spaces internal to the dispensing head, which spaces can be the chambers defined below. The inner wall has two opposite faces which are internal to the dispensing head. In particular, the inner wall is not an external partition of a supply channel for the product, in particular of a central channel of the dispensing head.

The use of the word "endpiece" does not exclude the possibility that the endpiece can comprise an attached element defining the end of the dispensing head. Within the meaning of the invention, the endpiece is arranged axially above the body when the device is arranged vertically along its longitudinal axis X or when the dispensing head is arranged vertically along its longitudinal axis Y.

The presence of the inner wall makes it possible to at least partially close the supply channel and to create a pressure drop downstream from the inner wall, inside the diffuser. This pressure drop makes it possible to reduce the pressure of the product arriving at the outlet orifice(s) and, if so desired, to do without attached nozzles for dispensing the product.

The inner wall can allow several passages to be formed for the product leaving the supply channel. The presence of several passages for the product is particularly useful when the aim is to dispense the product through several outlet orifices, since this makes it possible to divide the flow of product from the channel very early on and, therefore, to more easily create, within the diffuser, paths which lead to the outlet orifices and which allow the pressure to be further reduced. In this way, it is possible for the product to emerge directly, without attached nozzles.

The dispensing head can comprise just two components, namely the body and the endpiece, in particular the diffuser, that are mentioned above. The dispensing head can be without a third component separate from these.

The invention is very particularly suitable for the dispensing heads with which pressurized containers are equipped.

The endpiece, in particular the diffuser, can be solid in the area of its longitudinal axis or, alternatively, it can be hollow in the area of its longitudinal axis.

The dispensing head can comprise at least a first at least partially annular chamber, in particular a cylindrical chamber, through which the flow of product passes before emerging from the outlet orifices. The first at least partially annular chamber can extend along the longitudinal axis Y and be inclined with respect to a longitudinal axis X of the device by a non-zero angle γ.

The flow of product emerging from the dispensing head may have undergone in particular at least one change of direction of the flow, or at least two changes of direction of the flow.

"Change of direction" is to be understood as meaning that the flow of product passes from a first direction to a second direction, the two directions forming between them an angle preferably greater than 60°, or greater than 90°, preferably greater than 120°, or greater than 150°. In one illustrative embodiment, the flow of product undergoes at least one change of direction of greater than 120°, or greater than 150°, preferably of the order of 180°.

The dispensing head can comprise just two components, namely the body and the endpiece, in particular the diffuser, that are mentioned above. The dispensing head can be without a third component separate from these.

According to another of its aspects, independently of or in combination with the above, the invention further relates to a device for spraying a product, said device comprising:

a container containing the product, and a dispensing head comprising a body with a supply channel for the product coming from the container, and an endpiece, in particular a diffuser, defining several outlet orifices for the product, the outlet orifices leading directly to the outside, without an attached nozzle, the dispensing head comprising at least one inner wall for splitting a jet, which is different from a wall defining the end of the supply channel for the product in the endpiece.

According to another of its aspects, independently of or in combination with the above, the invention further relates to a device for spraying a product, said device comprising:

a container containing the product, and a dispensing head comprising a body with a supply channel for the product coming from the container, and an endpiece, in particular a diffuser, defining several outlet orifices for the product, the dispensing head comprising at least one inner wall for splitting a jet, which is different from a wall defining the end of the supply channel for the product in the endpiece, the endpiece, within the meaning of the invention, being arranged axially above the body when the device is arranged vertically along its longitudinal axis X or when the dispensing head is arranged vertically along its longitudinal axis Y.

According to another of its aspects, independently of or in combination with the above, the invention further relates to a device for spraying a product, said device comprising:

a container containing the product, and a dispensing head comprising a body with a supply channel for the product coming from the container, and an endpiece, in particular a diffuser, defining several outlet orifices for the product, the device comprising at least three outlet orifices, which are preferably not aligned, the dispensing head comprising at least one inner wall for splitting a jet, which is different from a wall defining the end of the supply channel for the product in the endpiece.

The longitudinal axis of the endpiece, in particular of the diffuser, can constitute an axis of symmetry of the endpiece, in particular of the diffuser.

The body can define a cannula through which said channel extends, this cannula having a longitudinal axis inclined with respect to the longitudinal axis of the container.

The endpiece, in particular the diffuser, can be attached to the body in such a way that, when they are assembled, the body and the endpiece, in particular the diffuser, define the one or more outlet orifices. Alternatively, the outlet orifices can be formed directly in the endpiece, in particular the diffuser. They can be formed in a curved portion of the endpiece, in particular of the diffuser, for example a portion with a hemispherical shape.

The endpiece, in particular the diffuser, preferably comprises several outlet orifices. The outlet orifices preferably lead directly to the outside, without an attached nozzle.

The outlet orifices can be distributed about a longitudinal axis Y of the endpiece, in particular of the diffuser, in particular in at least two different directions, which are in particular diametrically opposite.

The outlet orifices can be coplanar and arranged in an inclined plane with respect to the longitudinal axis X. The dispensing head can comprise in particular at least three coplanar outlet orifices, the directions of spraying being in particular arranged at at least 30°, or at least 60°, or at least 90° from each other.

The dispensing head can comprise at least a first at least partially annular chamber, in particular a cylindrical chamber, through which the flow of product passes before emerging from the outlet orifices. The first at least partially annular chamber can extend along the longitudinal axis Y and be inclined with respect to a longitudinal axis X of the device by a non-zero angle γ.

The dispensing head can comprise at least first and second chambers, in particular concentric chambers, through which the flow of product successively passes before emerging from the outlet orifices, at least one opening between the first and second concentric chambers being able to be offset angularly with respect to at least one of the outlet orifices. This angular offset is to be understood as being an offset about the axis of the concentric chambers or about the axis of the device, for example.

Thus, the flow of product emerging from the diffuser has in particular undergone at least two changes of direction of the flow in the diffuser, or even at least three changes of direction.

The spray device according to the invention permits targeted delivery, for example to the hair roots, and permits good spraying at the base of the hairs. The spraying of the product in at least two different directions makes it possible to reach areas situated around the dispensing head and to widen the delivery.

The changes of direction of the flow of product in the diffuser permit the creation of turbulence in the flow of product, thereby helping to reduce the size of the droplets or blobs of product. It is possible to obtain a gentler jet and to create a drop in pressure that promotes the comfort of the application.

The device according to the invention is particularly suitable for the delivery of powders containing fine particles and is able to prevent blockage of the dispensing orifices.

The concentric chambers can be at least partially annular or, indeed, annular. The dispensing head can in particular comprise a first inner chamber and a second outer chamber. The inner and outer chambers can be separated by a separation skirt. This separation skirt constitutes an inner wall within the meaning of the invention. It is able to ensure the leaktightness of the chambers.

This separation skirt can be pierced with at least one opening, or at least two openings, allowing the flow of product to pass through. Thus, the flow of product can be separated into at least two distinct streams. The openings in the separation skirt can be distributed uniformly on the circumference of the separation skirt. For example, they can be diametrically opposite when they are two in number. Their number can be an even number, in particular between 2 and 10, for example 2, 4, 6 or 8. The openings can extend along the entire height of the separation skirt or along only part thereof. The height of the separation skirt can be between 0.2 and 6 mm, or between 1 and 5 mm, for example of the order of 1.9 or 4 mm.

The second chamber can be surrounded by a peripheral skirt cooperating with the body in such a way as to ensure the closure of the second chamber. The outlet orifices can be distributed uniformly on the circumference of the peripheral skirt. For example, they are diametrically opposite when they are two in number. Their number can be an even number, in particular between 2 and 10, for example 2, 4, 6 or 8. They can be diametrically opposite in respective pairs. Such an arrangement of the outlet orifices may be able to lift the hair and promote distribution of the product over the whole scalp.

The outlet orifices can extend along the entire height of the peripheral skirt or along only part thereof. This height of the peripheral skirt can be between 0.2 and 8 mm, or between 1 and 6 mm, for example of the order of 1.9 or 5 mm.

The outlet orifices can be offset angularly with respect to the opening(s) of the separation skirt, each by an angle of between 0 and 180°, preferably between 20 and 90°, preferably between 30 and 80°, for example of the order of 45°.

The body can comprise an annular groove intended to receive the peripheral skirt of the diffuser. The annular groove is able to permit a continuous flow and a good supply to the orifices. This annular groove can be delimited by two concentric ribs, which are symmetrical in revolution about the longitudinal axis Y of the body and are configured to engage on each side of the peripheral skirt. The ribs can bear against shoulders present on the separation skirt and peripheral skirt, respectively. For example, the ribs each have a thickness $e_1$ and $e_2$ of between 0.2 and 2 mm, or between 0.5 and 1.5 mm, preferably between 0.6 and 1 mm, for example of the order of 0.7 mm.

The longitudinal axis Y of the diffuser can constitute an axis of symmetry of the diffuser.

The endpiece, in particular the diffuser, is preferably joined to the body at the top of the latter.

The endpiece, in particular the diffuser, can define the upper axial end of the dispensing head.

The endpiece, in particular the diffuser, can comprise an upper face of a generally curved shape with an outward convexity. The radius of curvature of this face can generally be between 0 and 20 mm, or between 2 and 10 mm, preferably between 3 and 9 mm, for example of the order of 6 mm.

The upper face of the endpiece, in particular of the diffuser, can comprise markers which indicate the direction of discharge of the jets. For example, these markers are reliefs with the general shape of a triangle, of which the point is oriented towards the edge of the upper face and towards the peripheral skirt.

The upper face of the diffuser can have a central depression with a circular contour. This central depression is able to accommodate an injection sprue, in such a way as to avoid injury to the skin.

The body and the diffuser can be joined together in particular by welding, for example by ultrasound. They can also be joined together in another way, for example by adhesive bonding. In this case, they are moulded separately before being joined. Alternatively, they are moulded in one piece, being connected to each other by a film hinge, for example, during the moulding.

The body can comprise a central channel intended to allow the flow of product to pass from the container to the diffuser. The body can define a cannula through which said channel extends, this cannula having a longitudinal axis inclined with respect to the longitudinal axis X of the container.

The central channel of the body can comprise a vertical portion, which extends in the longitudinal axis X of the device above the container, and an oblique portion, which is inclined by an angle γ with respect to the vertical portion. The angle γ can be between 0 and 90°, preferably between 5 and 40°, or between 10 and 30°, for example of the order of 15°. The oblique portion of the central channel can receive the diffuser. The annular groove and the abovementioned ribs of the body are arranged at an end of the body opposite a part for fixing the dispensing head on the container.

The vertical portion of the central channel is intended to receive the stem of the dispensing valve of the container.

The endpiece, in particular the diffuser, can be solid in the area of its longitudinal axis. It can comprise a stem allowing it to be fixed to the body, in particular by being inserted into the central channel of the body. It can be fixed by being inserted by force, with or without at least one fixation relief, for example a harpoon, and/or by snap-fit engagement. For this purpose, the stem can comprise a fixation relief intended to cooperate with a corresponding relief of the body. In one illustrative embodiment, the stem can comprise two diametrically opposite and partially annular notches as fixation reliefs. The body can comprise an annular groove for receiving an annular fixation bead protruding from the stem. The stem of the diffuser can have a harpoon shape.

The stem of the diffuser can constitute the sole means of fixing the diffuser on the body. The stem can be attached at the top to a dome-shaped wall which defines the aforementioned upper face of generally curved shape.

The stem of the diffuser can comprise at least one groove defining a passage for product from the channel to the diffuser, preferably two diametrically opposite grooves which each define a passage for product from the channel to the diffuser. In cross section, said grooves can have a contour in the shape of a segment of a circle. The grooves can extend between said notches mentioned above. Said one or more grooves are formed by a reinforcement extending along the stem of the diffuser. Their number can be an even number, in particular between 2 and 10, for example 2, 4, 6 or 8.

Alternatively, the device has no such stem.

In one variant, the device comprises at least one orifice allowing the product to pass from the body towards the diffuser. The device can comprise at least two orifices, which are two in number, for example, and diametrically opposite.

An indexing means can be used in order to allow the diffuser to be mounted on the body in a specified manner.

The device can be without a nozzle having swirl ducts, which fact simplifies its production. The outlet orifices can preferably lead directly to the outside, without an attached nozzle. An attached nozzle is understood as a component having at least one outlet orifice and comprising a plane wall in which the outlet orifice is formed, and also a mounting skirt, which can be mounted on a centre post.

The container can be pressurized. The container can in particular be an aerosol system delivering droplets of a product which is propelled by a propellant gas, liquefied or non-liquefied, comprising an alcohol solution or aqueous solution, and also, for example, polymer resins which, upon drying, form fine connections between the hairs. The product can be mixed with the propellant gas or be contained in a flexible bag surrounded by the propellant gas.

The container may or may not be refillable.

The device can comprise a closure cap intended to cover the body and the diffuser.

The dispensing head can be arranged so as to allow the protective cap to be fitted and can comprise, if need be, an on/off system that makes it possible to prevent the actuation of the device when the dispensing head is in a certain position with respect to the container or when a locking element of the dispensing head is in a certain position in relation to the latter.

Each jet emerging from the diffuser can be oriented generally along an axis not parallel to a longitudinal axis X of the device, in particular obliquely, for example being inclined with respect to the longitudinal axis of the device by an angle greater than 20°, preferably greater than 30°. The puff of the product emerging from an orifice can be utilized to lift the hairs, which promotes the application of the product to the scalp through other outlet orifices.

The flow emerging from each outlet orifice can be oriented perpendicularly with respect to the axis Y of the diffuser, the outlet orifices being coplanar, for example, and having axes oriented perpendicularly with respect to the axis Y of the diffuser.

Alternatively, the jet emerging from each outlet orifice can form an angle with the normal to this axis Y, in such a way that all the jets produce a resulting spray of substantially conical shape. This angle can be a non-zero angle, between 5 and 180°, preferably between 10 and 90°, or between 20 and 80°, preferably between 25 and 70°, for example of the order of 35°.

The device can comprise at least three outlet orifices, which are preferably not aligned. The distance E between the farthest outlet orifices can be less than 25 mm, preferably less than 20 mm, or less than 15 mm, more preferably less than 12 mm, or less than 10 mm. This distance is, for example, of the order of 12 mm or 10 mm or 8 mm. This distance E is defined as being the shortest distance between the axes of the orifices in the area of the surface of the dispensing head.

The dispensing of the product can be triggered by tilting the body with respect to the container. For this purpose, the body can comprise a bearing surface for the user's finger, said bearing surface being defined by a wall which, for example, is connected by a hinge to the part for fixing on the container.

Dispensing Head with Outlet Orifices Upon Assembly

According to another of its aspects, the invention relates to a device for spraying a product, in particular a cosmetic product, makeup product or care product, said device comprising:

a container containing the product, and a dispensing head comprising a body, with a supply channel for the product coming from the container, and an endpiece, in particular a diffuser, attached to the body, the body and the endpiece, when assembled, defining several outlet orifices about a longitudinal axis Y of the endpiece, in particular in at least two different directions, which are in particular diametrically opposite.

The use of the word "endpiece" does not exclude the possibility that the endpiece can comprise an attached element defining the end of the dispensing head.

The dispensing head can comprise at least a first at least partially annular chamber, in particular a cylindrical chamber, through which the flow of product passes before emerging from the outlet orifices. The first at least partially annular chamber can extend along the longitudinal axis Y and be inclined with respect to a longitudinal axis X of the device by a non-zero angle $\gamma$.

The flow of product emerging from the dispensing head may have undergone in particular at least one change of direction of the flow, or at least two changes of direction of the flow.

"Change of direction" is to be understood as meaning that the flow of product passes from a first direction to a second direction, the two directions forming between them an angle preferably greater than 60°, or greater than 90°, preferably greater than 120°, or greater than 150°. In one illustrative embodiment, the flow of product undergoes at least one change of direction of greater than 120°, or greater than 150°, preferably of the order of 180°.

The dispensing head can comprise just two components, namely the body and the endpiece, in particular the diffuser, that are mentioned above. The dispensing head can be without a third component separate from these.

According to another of its aspects, independently of or in combination with the above, the invention further relates to a device for spraying a product, said device comprising:

a container containing the product, and a dispensing head on top of the container, the dispensing head comprising a body arranged on the container and cooperating with a diffuser, the body and the diffuser being configured to allow the product to be sprayed through outlet orifices in at least two different directions, which are in particular diametrically opposite, the dispensing head comprising at least first and second chambers, in particular concentric chambers, through which the flow of product successively passes before emerging from the outlet orifices, at least one opening between the first and second concentric chambers being able to be offset angularly with respect to at least one of the outlet orifices. This angular offset is to be understood as being an offset about the axis of the concentric chambers or about the axis of the device, for example.

Thus, the flow of product emerging from the diffuser has in particular undergone at least two changes of direction of the flow in the diffuser, or even at least three changes of direction.

The spray device according to the invention permits targeted delivery, for example to the hair roots, and permits good spraying at the base of the hairs. The spraying of the product in at least two different directions makes it possible to reach areas situated around the dispensing head and to widen the delivery.

The changes of direction of the flow of product in the diffuser permit the creation of turbulence in the flow of product, thereby helping to reduce the size of the droplets or blobs of product. It is possible to obtain a gentler jet and to create a drop in pressure that promotes the comfort of the application.

The device according to the invention is particularly suitable for the delivery of powders containing fine particles and is able to prevent blockage of the dispensing orifices.

According to another of its aspects, independently of or in combination with the above, the invention further relates to a product-dispensing head comprising a body intended to be arranged on a container along a longitudinal axis X and having a supply channel for the product, the dispensing head being configured to permit spraying of the product through outlet orifices in at least one direction transverse to a longitudinal axis Y, in particular in at least two different directions, which are in particular diametrically opposite, the longitudinal axis Y being inclined with respect to the longitudinal axis X by a non-zero angle.

According to another of its aspects, independently of or in combination with the above, the invention further relates to a product-dispensing device having a body with longitudinal axis X, the dispensing head being configured to permit spraying of the product through outlet orifices in at least two different directions, or in at least three different directions, which are in particular diametrically opposite, the outlet orifices being coplanar and being arranged in a plane inclined with respect to the longitudinal axis X, the dispensing head in particular comprising at least three coplanar outlet orifices, the spraying directions being in particular arranged at at least 30°, or at least 60°, or at least 90° from each other.

The concentric chambers can be at least partially annular or, indeed, annular. The dispensing head can in particular comprise a first inner chamber and a second outer chamber. The inner and outer chambers can be separated by a separation skirt. This skirt is able to ensure the leaktightness of the chambers.

This separation skirt can be pierced with at least one opening, or at least two openings, allowing the flow of product to pass through. Thus, the flow of product can be separated into at least two distinct streams. The openings in the separation skirt can be distributed uniformly on the circumference of the separation skirt. For example, they can be diametrically opposite when they are two in number. Their number can be an even number, in particular between 2 and 10, for example 2, 4, 6 or 8. The openings can extend along the entire height of the separation skirt or along only part thereof. The height of the separation skirt can be between 0.2 and 6 mm, or between 1 and 5 mm, for example of the order of 1.9 or 4 mm.

The second chamber can be surrounded by a peripheral skirt cooperating with the body in such a way as to ensure the closure of the second chamber. The outlet orifices can be distributed uniformly on the circumference of the peripheral skirt. For example, they are diametrically opposite when they are two in number. Their number can be an even number, in particular between 2 and 10, for example 2, 4, 6 or 8. They can be diametrically opposite in respective pairs. Such an arrangement of the outlet orifices may be able to lift the hair and promote distribution of the product over the whole scalp.

The outlet orifices can extend along the entire height of the peripheral skirt or along only part thereof. This height of the peripheral skirt can be between 0.2 and 8 mm, or between 1 and 6 mm, for example of the order of 1.9 or 5 mm.

The outlet orifices can be offset angularly with respect to the opening(s) of the separation skirt, each by an angle of between 0 and 180°, preferably between 20 and 90°, preferably between 30 and 80°, for example of the order of 45°.

The body can comprise an annular groove intended to receive the peripheral skirt of the diffuser. The annular groove is able to permit a continuous flow and a good supply to the orifices. This annular groove can be delimited by two concentric ribs, which are symmetrical in revolution about the longitudinal axis Y of the body and are configured to engage on each side of the peripheral skirt. The ribs can bear against shoulders present on the separation skirt and peripheral skirt, respectively. For example, the ribs each have a thickness $e_1$ and $e_2$ of between 0.2 and 2 mm, or between 0.5 and 1.5 mm, preferably between 0.6 and 1 mm.

The longitudinal axis Y of the diffuser can constitute an axis of symmetry of the diffuser.

The diffuser is preferably joined to the body at the top of the latter.

The diffuser can define the upper axial end of the dispensing head.

The diffuser can comprise an upper face of a generally curved shape with an outward convexity. The radius of curvature of this face can be generally between 2 and 10 mm, or between 3 and 9 mm, for example of the order of 6 mm.

The upper face of the diffuser can comprise markers which indicate the direction of discharge of the jets. For example, these markers are reliefs with the general shape of a triangle, of which the point is oriented towards the edge of the upper face and towards the peripheral skirt.

The upper face of the diffuser can have a central depression with a circular contour. This central depression is able to accommodate an injection sprue, in such a way as to avoid injury to the skin.

The body and the diffuser can be joined together in particular by welding, for example by ultrasound. They can also be joined together in another way, for example by adhesive bonding. In this case, they are moulded separately before being joined. Alternatively, they are moulded in one piece, being connected to each other by a film hinge, for example, during the moulding.

The body can comprise a central channel intended to allow the flow of product to pass from the container to the diffuser. The body can define a cannula through which said channel extends, this cannula having a longitudinal axis inclined with respect to the longitudinal axis X of the container.

The central channel of the body can comprise a vertical portion, which extends in the longitudinal axis X of the device above the container, and an oblique portion, which is inclined by an angle γ with respect to the vertical portion. The angle γ can be between 0 and 90°, preferably between 5 and 40°, or between 10 and 30°, for example of the order of 15°. The oblique portion of the central channel can receive the diffuser. The annular groove and the abovementioned ribs of the body are arranged at an end of the body opposite a part for fixing the body on the container.

Dispensing Head with Stem

It is known for products, in particular cosmetic products, to be packaged in pressurized containers. The latter are equipped with dispensing heads defining one or more dispensing orifices through which the product can be dispensed in the form of a spray or sprays. The particle size of the spray droplets depends in particular on the product flowrate, the pressure and the size of the one or more dispensing orifices.

It is customary to use dispensing heads equipped with attached nozzles, in particular with swirl ducts. Such nozzles comprise a wall which, at its centre, has a dispensing orifice passing through it and which, at its periphery, is provided with a tubular mounting skirt. The nozzle is mounted on a peg, also called a centre post, of which the end is positioned generally in contact with the inner face of said wall. Channels are formed on the end of the peg in order to allow the product to reach the dispensing orifice. Given the small space existing between the opposing faces of the nozzle and of the peg, a significant pressure drop can be created so as to lower the pressure and obtain an acceptable spray.

The disadvantage of such dispensing heads is their cost, since the one or more attached nozzles constitute a supplementary component that complicates the manufacture of the head.

There is therefore a need to make the manufacture of the dispensing heads easier while at the same time obtaining acceptable spray characteristics.

According to another of its aspects, the invention meets this need by virtue of a packaging and dispensing device for a product, in particular a cosmetic product, makeup product or care product, in particular a device for spraying a product, said device comprising:

- a container containing the product to be dispensed, and
- a dispensing head comprising a body defining a supply channel for the product, and a diffuser at least partially defining at least one orifice for dispensing the product, the diffuser comprising a stem engaged in the supply channel and defining with the latter at least one passage for product from the supply channel to the diffuser.

The presence of the stem makes it possible to at least partially close the supply channel and to create a pressure drop downstream from the stem, inside the diffuser. This pressure drop makes it possible to reduce the pressure of the product arriving at the dispensing orifice(s) and, if so desired, to do without attached nozzles for dispensing the product.

The stem can allow the formation of several passages for the product leaving the channel, in particular two diametrically opposite passages. The presence of several passages for the product is particularly useful when the aim is to dispense the product through several dispensing orifices, since this makes it possible to divide the flow of product from the channel very early on and, therefore, to more easily create, within the diffuser, paths which lead to the dispensing orifices and which allow the pressure to be further reduced. In this way, it is possible for the product to emerge directly, without attached nozzles.

The dispensing head can comprise just two components, namely the body, in particular the body, and the diffuser, that are mentioned above. The dispensing head can be without a third component separate from these.

The invention is very particularly suitable for the dispensing heads with which pressurized containers are equipped.

The diffuser can be solid in the area of its longitudinal axis.

The stem preferably serves for fixing the diffuser on said body. The stem can constitute the sole means of fixing the diffuser on said body.

It can be fixed by being inserted by force, with or without at least one fixation relief, for example a harpoon, and/or by snap-fit engagement. For this purpose, the stem can comprise a fixation relief intended to cooperate with a corresponding relief of the body. The stem can comprise at least one relief for fixing in the channel, in particular by snap-fit engagement. The stem can in particular comprise two partially annular notches, diametrically opposite each other, as fixation reliefs. The body can comprise an annular groove in order to receive an annular fixation bead protruding from the stem. The stem of the diffuser can have a harpoon shape.

The stem can be attached at the top to a dome-shaped wall which defines an upper face of generally curved shape.

The stem of the diffuser can comprise at least one groove defining a passage for product from the channel to the diffuser, preferably two diametrically opposite grooves which each define a passage for product from the channel to the diffuser. In cross section, said grooves can have a contour in the shape of a segment of a circle. The grooves can extend between said notches mentioned above. Said one or more grooves are formed by a reinforcement extending along the stem of the diffuser. Their number can be an even number, in particular between 2 and 10, for example 2, 4, 6 or 8.

The diffuser preferably comprises several dispensing orifices. The dispensing orifices preferably lead directly to the outside, without an attached nozzle.

The outlet orifices can be distributed about a longitudinal axis Y of the diffuser, in particular in at least two different directions, which are in particular diametrically opposite.

The longitudinal axis Y of the diffuser can constitute an axis of symmetry of the diffuser.

The body can define a cannula through which said channel extends, this cannula having a longitudinal axis inclined with respect to the longitudinal axis of the container.

The diffuser can be attached to the body in such a way that, when they are assembled, the body and the diffuser define the one or more outlet orifices. Alternatively, the dispensing orifices can be formed directly in the diffuser. They can be formed in a curved portion of the diffuser, for example a portion with a hemispherical shape.

The diffuser preferably comprises a peripheral skirt, in particular an annular skirt, engaging in a corresponding groove of said body.

The dispensing head can comprise at least a first at least partially annular chamber, in particular a cylindrical chamber, through which the flow of product passes before emerging from the outlet orifices. The first at least partially annular chamber can extend along the longitudinal axis Y and be inclined with respect to a longitudinal axis X of the device by a non-zero angle $\gamma$.

The flow of product emerging from the dispensing head may have undergone in particular at least one change of direction of the flow, or at least two changes of direction of the flow.

"Change of direction" is to be understood as meaning that the flow of product passes from a first direction to a second direction, the two directions forming between them an angle preferably greater than 60°, or greater than 90°, preferably greater than 120°, or greater than 150°. In one illustrative embodiment, the flow of product undergoes at least one change of direction of greater than 120°, or greater than 150°, preferably of the order of 180°.

The dispensing head can in particular comprise at least first and second chambers, in particular concentric chambers, through which the flow of product successively passes before emerging from the outlet orifices, at least one opening between the first and second concentric chambers being able to be offset angularly with respect to at least one of the outlet orifices. This angular offset is to be understood as being an offset about the axis of the concentric chambers or about the axis of the device, for example.

In one illustrative embodiment, the body can define, with the diffuser, two concentric chambers through which the product from the channel flows after it has negotiated the one or more passages, the two chambers being separated by an annular wall, in particular an inner separation skirt, provided with at least one opening angularly offset, about the axes of the chambers, with respect to at least one dispensing orifice.

The body and the diffuser can be configured to allow the product to be sprayed through outlet orifices in at least two different directions, which are in particular diametrically opposite. Thus, the flow of product emerging from the diffuser has in particular undergone at least two changes of direction of the flow in the diffuser, or even at least three changes of direction.

The spray device according to the invention permits targeted delivery, for example to the hair roots, and permits good spraying at the base of the hairs. The spraying of the product in at least two different directions makes it possible to reach areas situated around the dispensing head and to widen the delivery.

The changes of direction of the flow of product in the diffuser permit the creation of turbulence in the flow of product, thereby helping to reduce the size of the droplets or blobs of product. It is possible to obtain a gentler jet and to create a drop in pressure that promotes the comfort of the application.

The device according to the invention is particularly suitable for the delivery of powders containing fine particles and is able to prevent blockage of the dispensing orifices.

The outlet orifices can be coplanar and arranged in an inclined plane with respect to the longitudinal axis X. The dispensing head can comprise in particular at least three coplanar outlet orifices, the directions of spraying being in particular arranged at at least 30°, or at least 60°, or at least 90° from each other.

The body can comprise an annular groove intended to receive the peripheral skirt of the diffuser. The annular groove is able to permit a continuous flow and a good supply to the orifices. This annular groove can be delimited by two concentric ribs, which are symmetrical in revolution about the longitudinal axis Y of the body and are configured to engage on each side of the peripheral skirt. The ribs can bear against shoulders present on the separation skirt and peripheral skirt, respectively. For example, the ribs each have a thickness $e_1$ and $e_2$ of between 0.2 and 2 mm, or between 0.5 and 1.5 mm, preferably between 0.6 and 1 mm, for example of the order of 0.7 mm.

Dispensing Head with Angular Course

Pressurized containers are known containing a haircare product and provided with a dispensing head comprising a cannula through which the product can be delivered to the hair. The valve traditionally comprises a hollow valve stem, of which the movement triggers the dispensing of the product. The valve can be triggered by pressing down the stem or can be triggered by tilting.

It proves advantageous to dispense the product via a diffuser with multiple outlet orifices present at the end of the cannula. The orifices can be distributed symmetrically about the longitudinal axis of the cannula.

There is a need to permit optimal dispensing of the product within the hair, with a hand movement that is both precise and easy for the user.

According to another of its aspects, the invention aims to meet this need by virtue of a device for packaging and dispensing a product, in particular a cosmetic produce, makeup product or care product, said device comprising:

- a pressurized container containing the product to be dispensed,
- a valve comprising a hollow stem through which the product emerges and which, by being displaced, makes it possible to trigger the dispensing of the product coming from the container, and
- a dispensing head comprising a movable part which is able to pivot with respect to the container in such a way as to trigger the dispensing of product after it has pivoted by a given angular course, this movable part comprising a dispensing cannula which, at rest, extends along a longitudinal axis Y inclined with respect to the longitudinal axis X of the container by an angle which substantially corresponds to said angular course, in such a way that the longitudinal axis Y of the cannula of the movable part is substantially parallel to the longitudinal axis X of the container during the dispensing of the product.

The device according to the invention makes it possible, at the moment of dispensing, to have a cannula oriented substantially parallel to the longitudinal axis X of the container. This makes it easier for the user to orient the cannula with respect to the scalp when the cannula is engaged in the hair and no longer visible. The user can refer to the orientation of the container in order to bring the cannula to the orientation that is best suited to the desired treatment. This advantage is all the more important when the cannula has multiple dispensing orifices, since this makes it possible to more precisely orient the cannula substantially perpendicularly with respect to the scalp in order to allow each of the dispensing orifices to dispense the product optimally to the roots of the hair.

The movable part is preferably connected to a base part mounted fixedly on the container. In particular, the movable part and the base part can be moulded in one piece and together form a body of the dispensing head.

The angular course is preferably between 5 and 20°, or between 10 and 15°, preferably between 12 and 14°.

The valve is preferably triggered by pressing the hollow valve stem down, although in one variant the valve is triggered by tilting the hollow valve stem.

The invention is very particularly suitable for applying a hair-styling product or haircare product. The container can thus contain a haircare product.

The cannula of the movable part is preferably provided, at its end, with a diffuser having multiple outlet orifices. This diffuser can be attached to the movable part. It can be dome-shaped and is preferably substantially hemispherical.

It can comprise, for example, between 2 and 12 dispensing orifices distributed angularly at regular intervals about the longitudinal axis of the cannula.

The movable part can comprise a stub in which the hollow valve stem is engaged, this stub being situated inside a tubular enclosing skirt of the movable part. This enclosing skirt can be connected to the base part by a film hinge. Thus, the movable part in particular can be connected to the base part by a film hinge.

The longitudinal axis of the container and the longitudinal axis of the movable part are preferably coplanar. In particular, the longitudinal axis of the container and the longitudinal axis of the cannula of the movable part can intersect substantially at the base of the cannula of the movable part.

The dispensing head can comprise just two components, namely the body, which comprises the movable part and the base part, and the diffuser, that are mentioned above. The dispensing head can be without a third component separate from these.

When assembled, the body and the diffuser can define the outlet orifices. Alternatively, the outlet orifices can be formed directly in the diffuser. They can be formed in a curved portion of the diffuser, for example a portion with a hemispherical shape.

The outlet orifices can be distributed about a longitudinal axis Y of the diffuser, in particular in at least two different directions, which are in particular diametrically opposite.

The outlet orifices can be coplanar and arranged in an inclined plane with respect to the longitudinal axis X. The dispensing head can comprise in particular at least three coplanar outlet orifices, the directions of spraying being in particular arranged at at least 30°, or at least 60°, or at least 90° from each other.

The dispensing head can comprise at least a first at least partially annular chamber, in particular a cylindrical chamber, through which the flow of product passes before emerging from the outlet orifices. The first at least partially annular chamber can extend along the longitudinal axis Y and be inclined with respect to a longitudinal axis X of the device by a non-zero angle γ.

The flow of product emerging from the dispensing head may have undergone in particular at least one change of direction of the flow, or at least two changes of direction of the flow.

"Change of direction" is to be understood as meaning that the flow of product passes from a first direction to a second direction, the two directions forming between them an angle preferably greater than 60°, or greater than 90°, preferably greater than 120°, or greater than 150°. In one illustrative embodiment, the flow of product undergoes at least one change of direction of greater than 120°, or greater than 150°, preferably of the order of 180°.

The dispensing head can comprise at least first and second chambers, in particular concentric chambers, through which the flow of product successively passes before emerging from the outlet orifices, at least one opening between the first and second concentric chambers being able to be offset angularly with respect to at least one of the outlet orifices. This angular offset is to be understood as being an offset about the axis of the concentric chambers or about the axis of the device, for example.

Thus, the flow of product emerging from the diffuser has in particular undergone at least two changes of direction of the flow in the diffuser, or even at least three changes of direction.

The spray device according to the invention permits targeted delivery, for example to the hair roots, and permits good spraying at the base of the hairs. The spraying of the product in at least two different directions makes it possible to reach areas situated around the dispensing head and to widen the delivery.

The changes of direction of the flow of product in the diffuser permit the creation of turbulence in the flow of product, thereby helping to reduce the size of the droplets or blobs of product. It is possible to obtain a gentler jet and to create a drop in pressure that promotes the comfort of the application.

The device according to the invention is particularly suitable for the delivery of powders containing fine particles and is able to prevent blockage of the dispensing orifices.

The concentric chambers can be at least partially annular or, indeed, annular. The dispensing head can in particular comprise a first inner chamber and a second outer chamber. The inner and outer chambers can be separated by a separation skirt. This skirt is able to ensure the leaktightness of the chambers.

This separation skirt can be pierced with at least one opening, or at least two openings, allowing the flow of product to pass through. Thus, the flow of product can be separated into at least two distinct streams. The openings in the separation skirt can be distributed uniformly on the circumference of the separation skirt. For example, they can be diametrically opposite when they are two in number. Their number can be an even number, in particular between 2 and 10, for example 2, 4, 6 or 8. The openings can extend along the entire height of the separation skirt or along only part thereof. The height of the separation skirt can be between 0.2 and 6 mm, or between 1 and 5 mm, for example of the order of 1.9 or 4 mm.

The second chamber can be surrounded by a peripheral skirt cooperating with the body in such a way as to ensure the closure of the second chamber. The outlet orifices can be distributed uniformly on the circumference of the peripheral skirt. For example, they are diametrically opposite when they are two in number. Their number can be an even number, in particular between 2 and 10, for example 2, 4, 6 or 8. They can be diametrically opposite in respective pairs. Such an arrangement of the outlet orifices may be able to lift the hair and promote distribution of the product over the whole scalp.

The outlet orifices can extend along the entire height of the peripheral skirt or along only part thereof. This height of the peripheral skirt can be between 0.2 and 8 mm, or between 1 and 6 mm, for example of the order of 1.9 or 5 mm.

The outlet orifices can be offset angularly with respect to the opening(s) of the separation skirt, each by an angle of between 0 and 180°, preferably between 20 and 90°, preferably between 30 and 80°, for example of the order of 45°.

The body can comprise an annular groove intended to receive the peripheral skirt of the diffuser. The annular groove is able to permit a continuous flow and a good supply to the orifices. This annular groove can be delimited by two concentric ribs, which are symmetrical in revolution about the longitudinal axis Y of the body and are configured to engage on each side of the peripheral skirt. The ribs can bear against shoulders present on the separation skirt and peripheral skirt, respectively. For example, the ribs each have a thickness $e_1$ and $e_2$ of between 0.2 and 2 mm, or between 0.5 and 1.5 mm, preferably between 0.6 and 1 mm, for example of the order of 0.7 mm.

The longitudinal axis Y of the diffuser can constitute an axis of symmetry of the diffuser.

The diffuser is preferably joined to the body at the top of the latter.

The diffuser can define the upper axial end of the dispensing head.

The diffuser can comprise an upper face of a generally curved shape with an outward convexity. The radius of curvature of this face can generally be between 0 and 20 mm, or between 2 and 10 mm, preferably between 3 and 9 mm, for example of the order of 6 mm.

The upper face of the diffuser can comprise markers which indicate the direction of discharge of the jets. For example, these markers are reliefs with the general shape of a triangle, of which the point is oriented towards the edge of the upper face and towards the peripheral skirt.

The upper face of the diffuser can have a central depression with a circular contour. This central depression is able to accommodate an injection sprue, in such a way as to avoid injury to the skin.

The body and the diffuser can be joined together in particular by welding, for example by ultrasound. They can also be joined together in another way, for example by adhesive bonding. In this case, they are moulded separately before being joined. Alternatively, they are moulded in one piece, being connected to each other by a film hinge, for example, during the moulding.

The body can comprise a central channel intended to allow the flow of product to pass from the container to the diffuser, which is formed in the cannula. The central channel of the body can comprise a vertical portion, which extends in the longitudinal axis X of the device above the container, and an oblique portion, which is inclined by an angle γ with respect to the vertical portion. The angle γ can be between 0 and 90°, preferably between 5 and 40°, or between 10 and 30°, for example of the order of 15°. The oblique portion of the central channel can receive the diffuser. The annular groove and the abovementioned ribs of the body are arranged at an end of the body opposite the base part for fixing the dispensing head on the container.

The vertical portion of the central channel is intended to receive the stem of the dispensing valve of the container.

The diffuser can be solid in the area of its longitudinal axis. It can comprise a stem allowing it to be fixed to the body, in particular by being inserted into the central channel of the body. It can be fixed by being inserted by force, with or without at least one fixation relief, for example a harpoon, and/or by snap-fit engagement. For this purpose, the stem can comprise a fixation relief intended to cooperate with a corresponding relief of the body. In one illustrative embodiment, the stem can comprise two diametrically opposite and partially annular notches as fixation reliefs. The body can comprise an annular groove for receiving an annular fixation bead protruding from the stem. The stem of the diffuser can have a harpoon shape.

The stem of the diffuser can constitute the sole means of fixing the diffuser on the body. The stem can be attached at the top to a dome-shaped wall which defines the aforementioned upper face of generally curved shape.

The stem of the diffuser can comprise at least one groove defining a passage for product from the channel to the diffuser, preferably two diametrically opposite grooves which each define a passage for product from the channel to the diffuser. In cross section, said grooves can have a contour in the shape of a segment of a circle. The grooves can extend between said notches mentioned above. Said one or more grooves are formed by a reinforcement extending along the stem of the diffuser. Their number can be an even number, in particular between 2 and 10, for example 2, 4, 6 or 8.

Alternatively, the device has no such stem.

In one variant, the device comprises at least one orifice allowing the product to pass from the body towards the diffuser. The device can comprise at least two orifices, which are two in number, for example, and diametrically opposite.

An indexing means can be used in order to allow the diffuser to be mounted on the body in a specified manner.

The device can be without a nozzle having swirl ducts, which fact simplifies its production. The dispensing orifices can preferably lead directly to the outside, without an attached nozzle. An attached nozzle is understood as a component having at least one outlet orifice and comprising a plane wall in which the outlet orifice is formed, and also a mounting skirt, which can be mounted on a centre post.

The container is pressurized. The container can in particular be an aerosol system delivering droplets of a product which is propelled by a propellant gas, liquefied or non-liquefied, comprising an alcohol solution or aqueous solution, and also, for example, polymer resins which, upon drying, form fine connections between the hairs. The product can be mixed with the propellant gas or be contained in a flexible bag surrounded by the propellant gas.

The container may or may not be refillable.

The device can comprise a closure cap intended to cover the body and the diffuser.

The dispensing head can be arranged so as to allow the protective cap to be fitted and can comprise, if need be, an on/off system that makes it possible to prevent the actuation of the device when the dispensing head is in a certain position with respect to the container or when a locking element of the dispensing head is in a certain position in relation to the latter.

Each jet emerging from the diffuser can be oriented generally along an axis not parallel to a longitudinal axis X of the device, in particular obliquely, for example being inclined with respect to the longitudinal axis of the device by an angle greater than 10°, preferably greater than 20°, more preferably greater than 30°. The puff of the product emerging from an orifice can be utilized to lift the hairs, which promotes the application of the product to the scalp through other outlet orifices.

The flow emerging from each outlet orifice can be oriented perpendicularly with respect to the axis Y of the diffuser, the outlet orifices being coplanar, for example, and having axes oriented perpendicularly with respect to the axis Y of the diffuser.

Alternatively, the jet emerging from each outlet orifice can form an angle with the normal to this axis Y, in such a way that all the jets produce a resulting spray of substantially conical shape. This angle can be a non-zero angle, between 5 and 180°, preferably between 10 and 90°, or between 20 and 80°, preferably between 25 and 70°, for example of the order of 35°.

The device can comprise at least three outlet orifices, which are preferably not aligned. The distance between the farthest outlet orifices can be less than 25 mm, preferably less than 20 mm, or less than 15 mm, for example of the order of 12 mm or 10 mm.

The dispensing of the product can be triggered by tilting the body with respect to the container. For this purpose, the body can comprise a bearing surface on the movable part for the user's finger, said bearing surface being defined by a wall which, for example, is connected by a hinge to the base part for fixing on the container.

DETAILED DESCRIPTION

Figure 2:
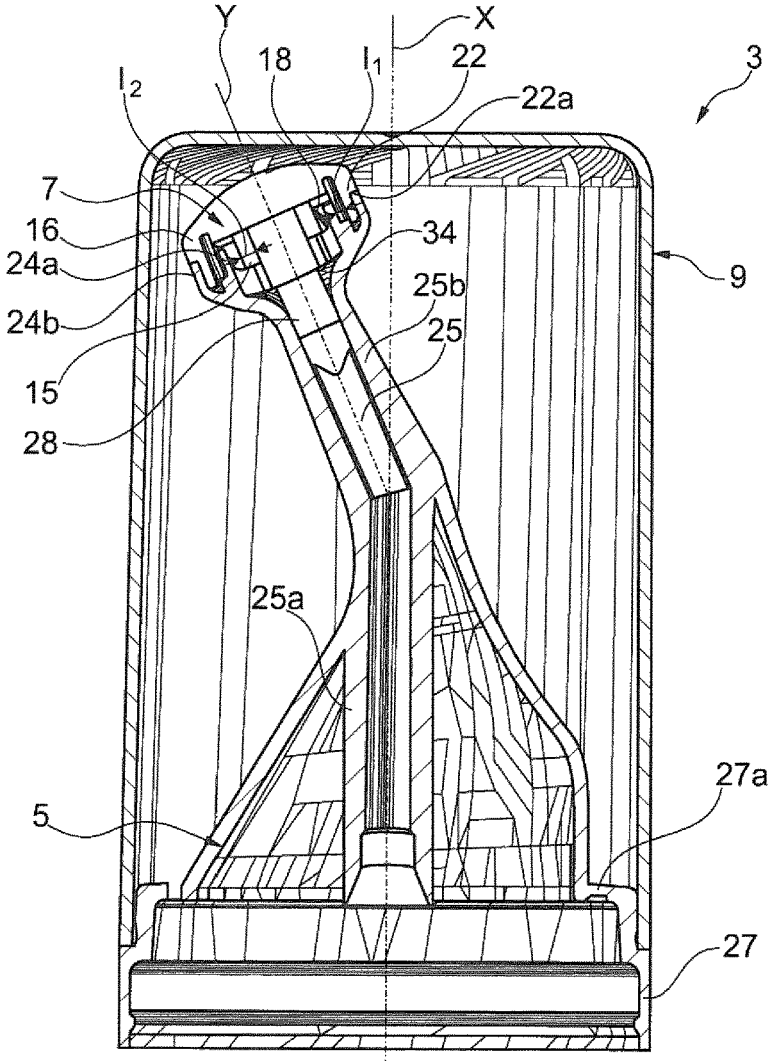
Figure 3:
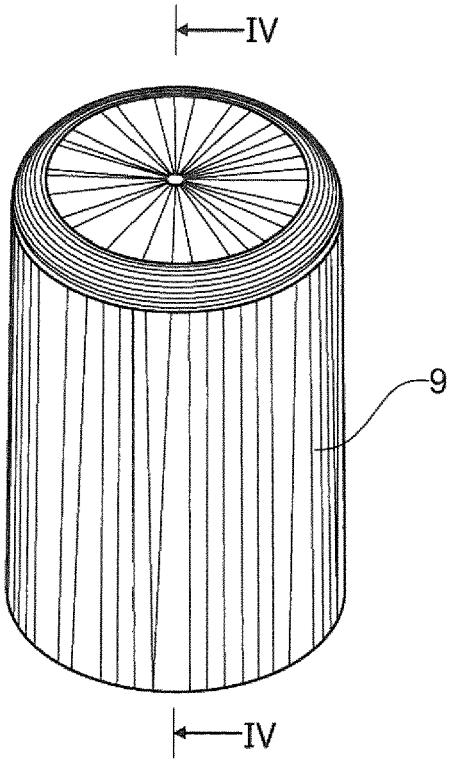
Figure 4:
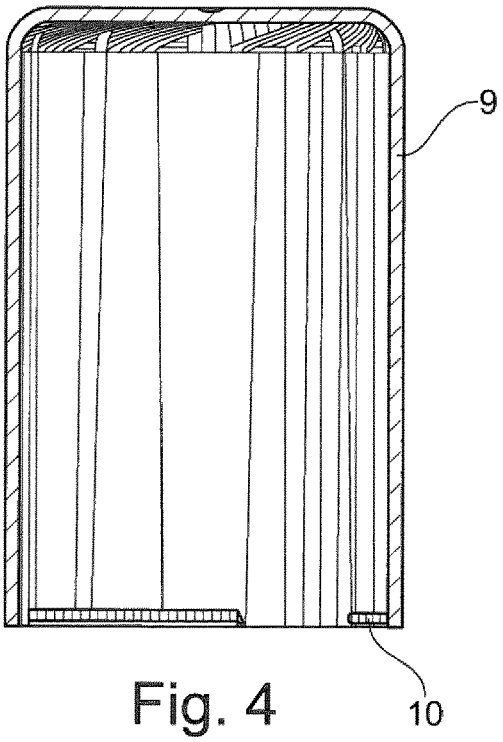
Figure 5:
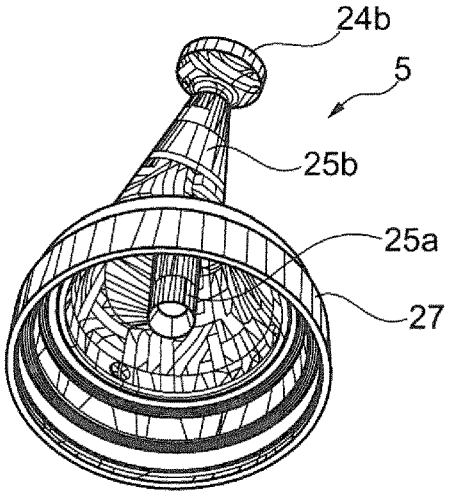
Figure 6:
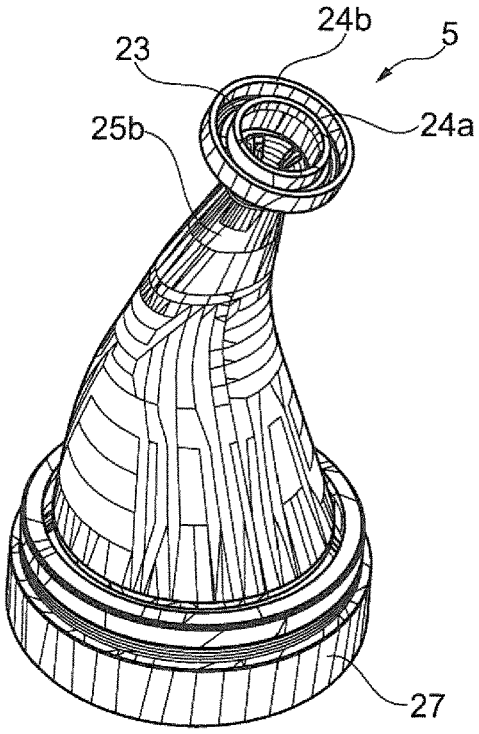
Figure 7:
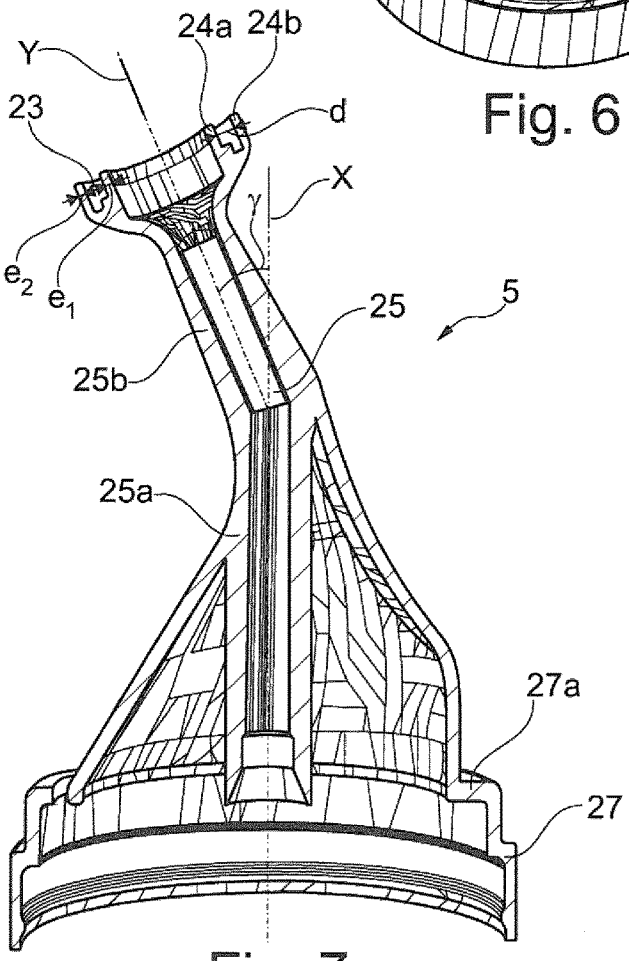
Figure 8:
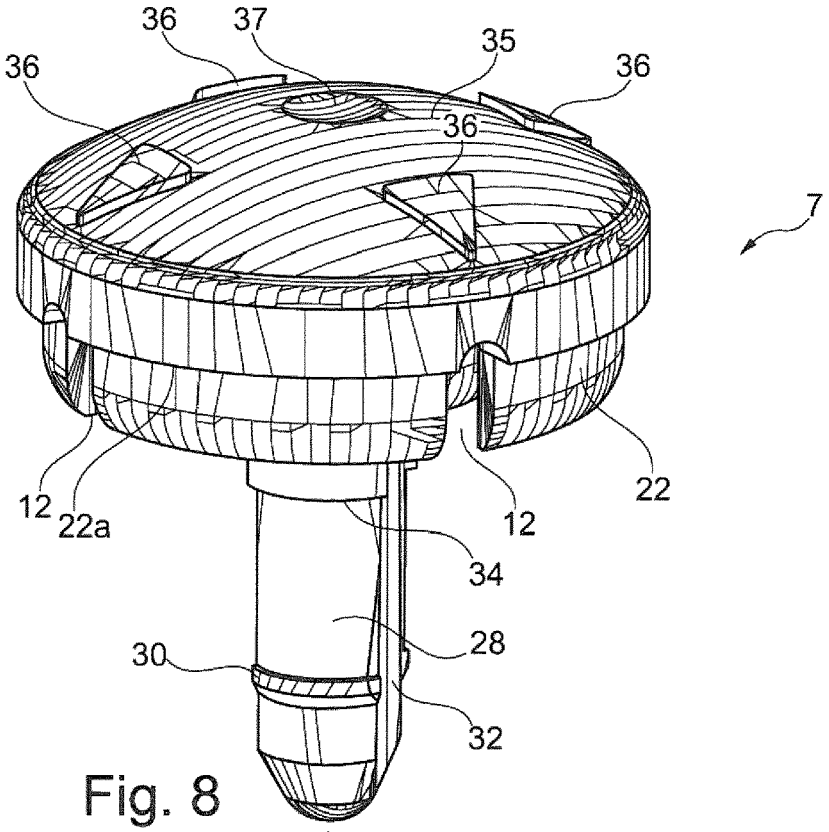
Figure 9:
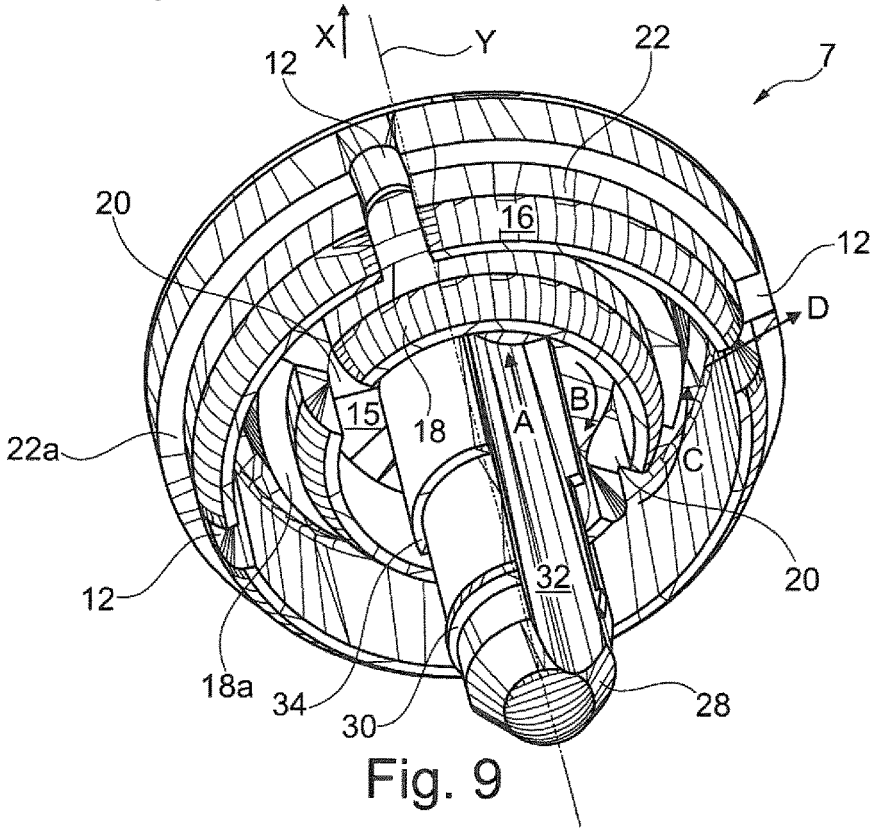
Figure 10:
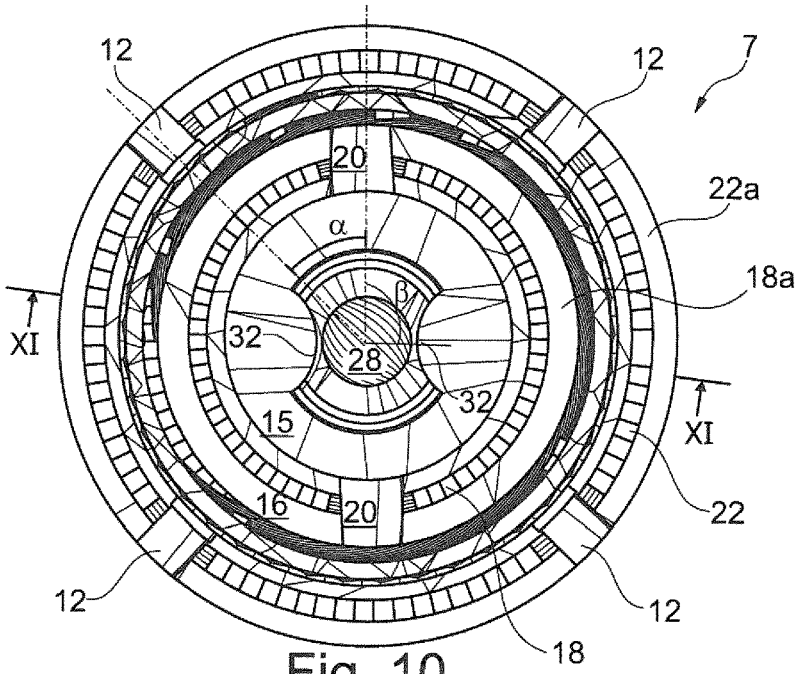
Figure 11:
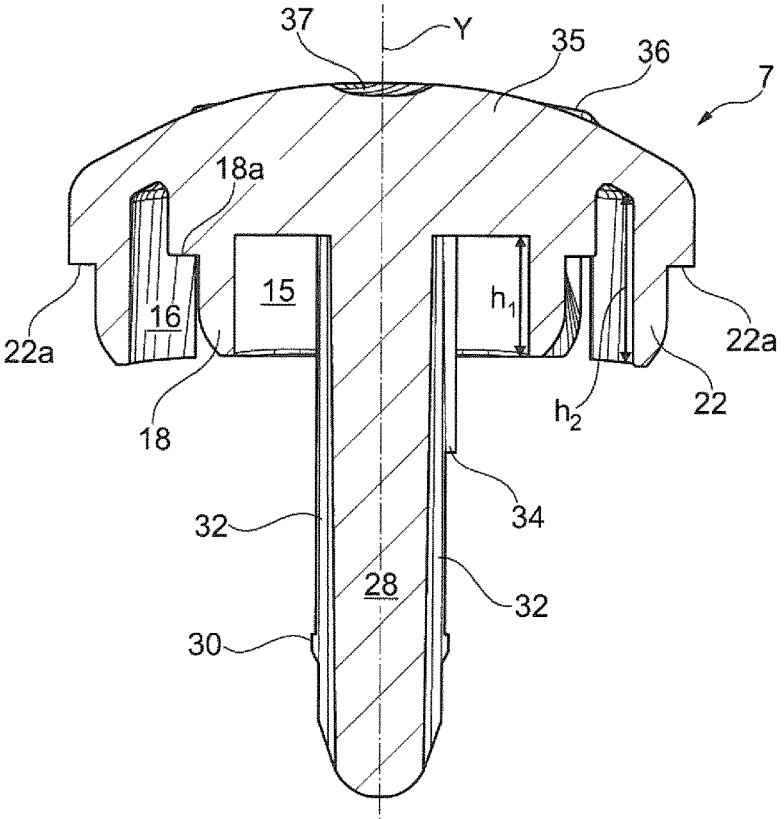
Figure 12:
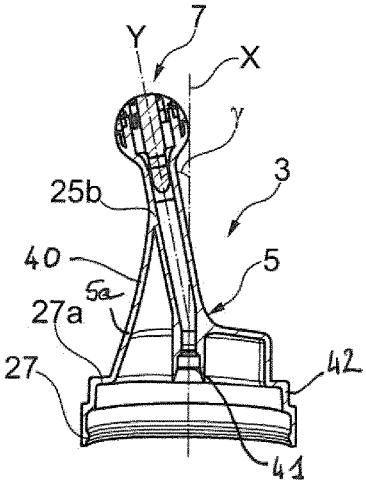
Figure 13:
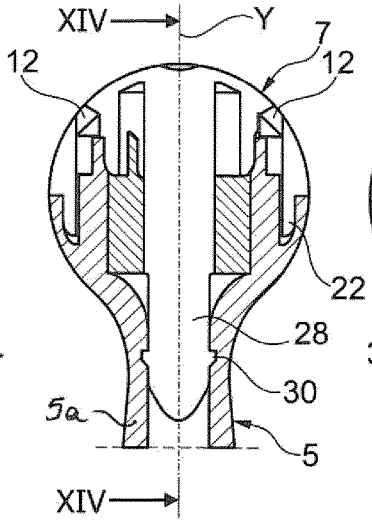
Figure 14:
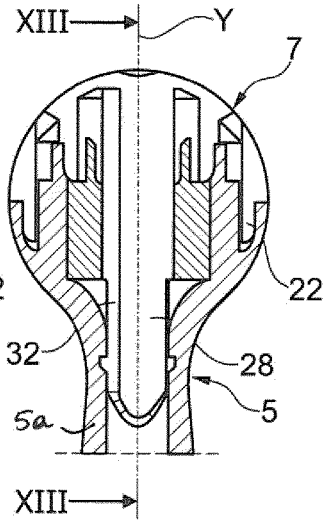
Figure 16:
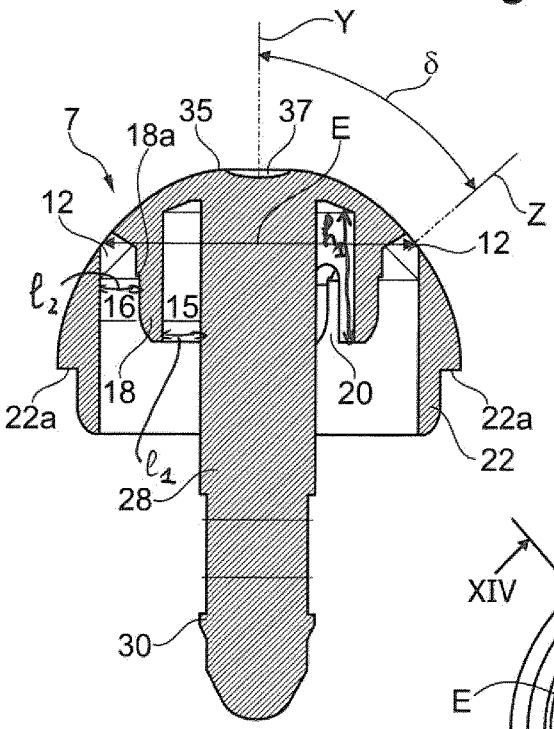
Figure 15:
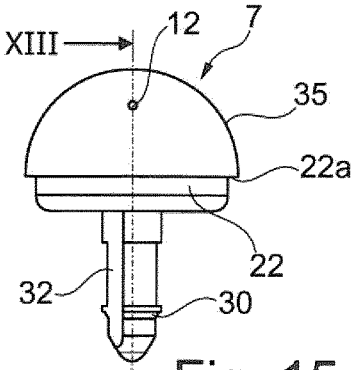
Figure 17:
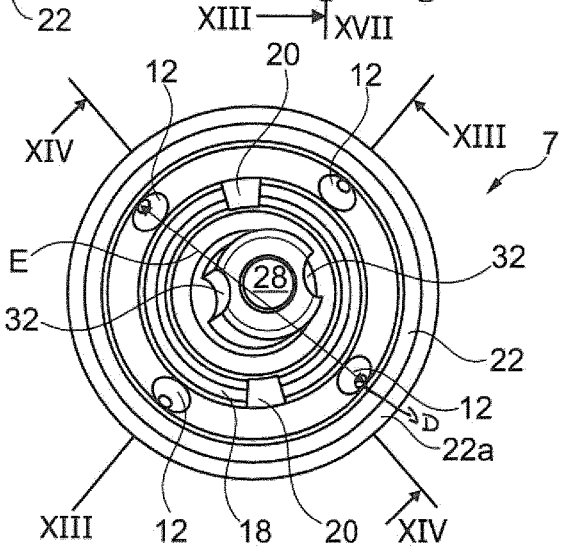
Figure 25:
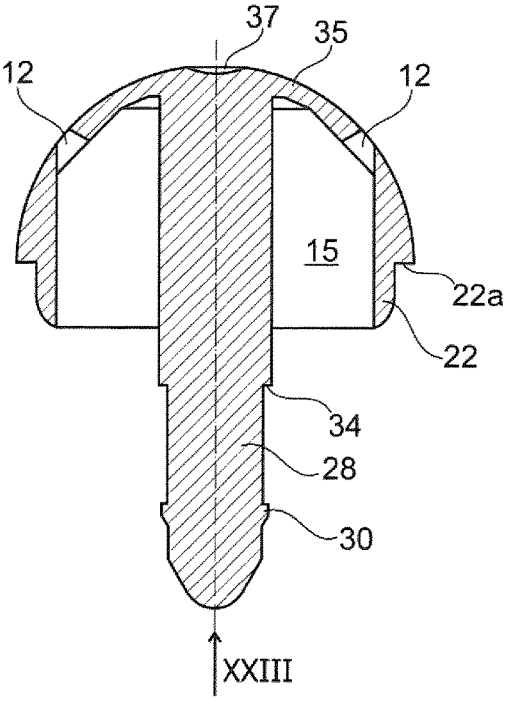
Figure 26:
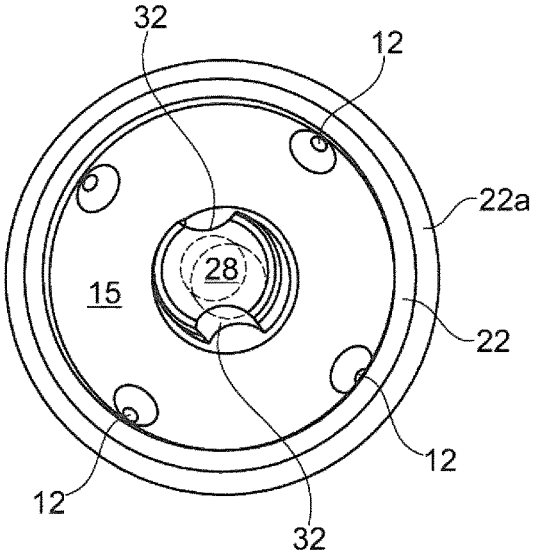
Figure 12A:
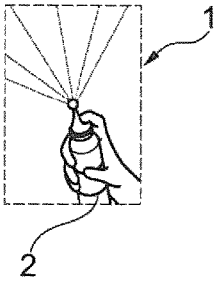
Figure 12B:
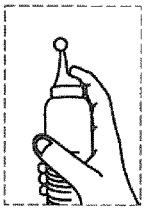
Figure 12C:
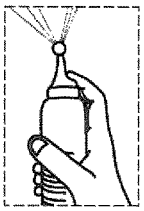
Figure 18:
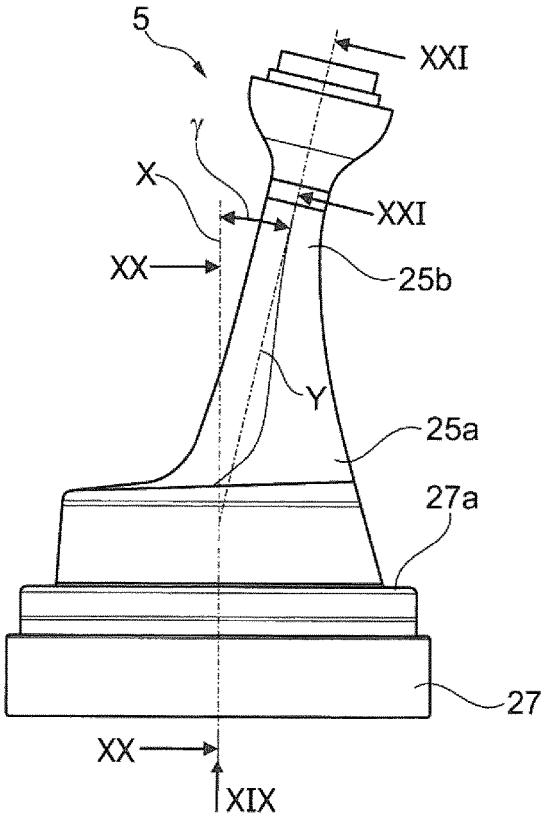
Figure 19:
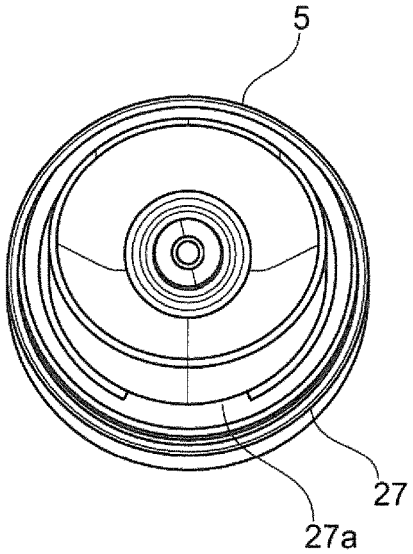
Figure 20:
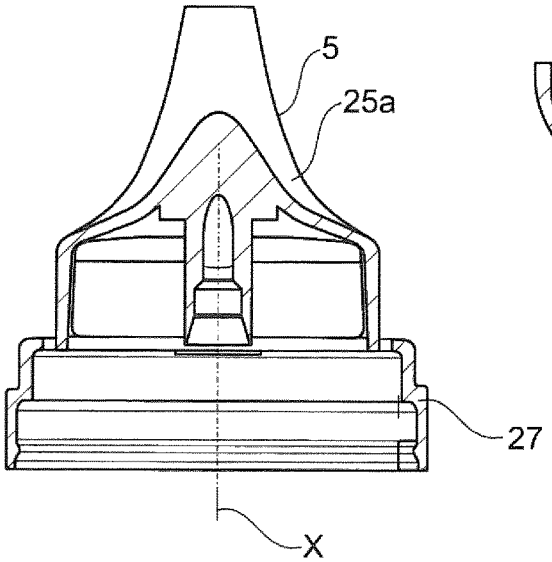
Figure 21:
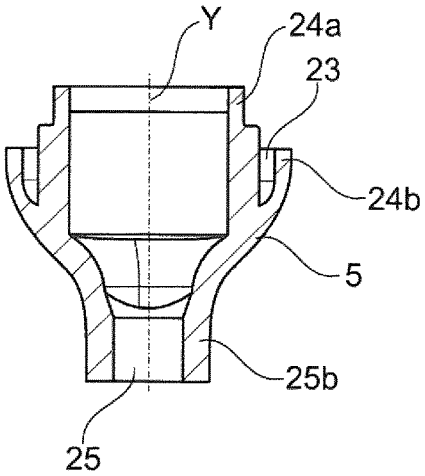
Figure 22:
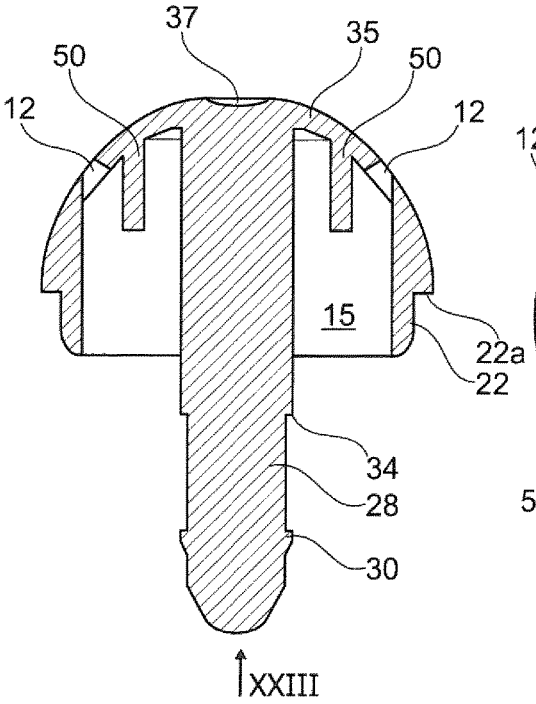
Figure 23:
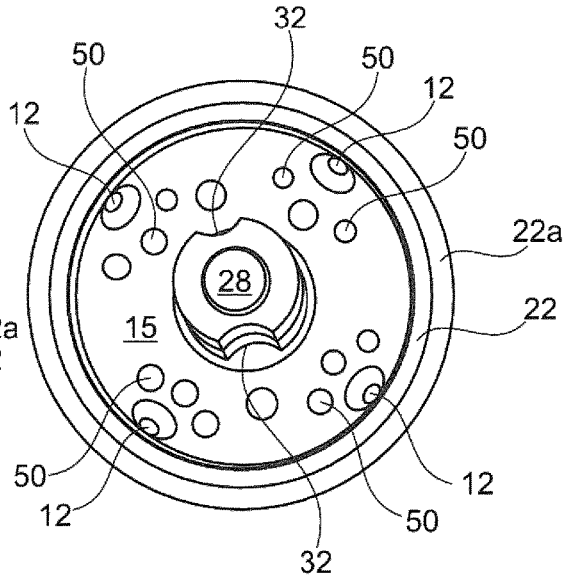

The invention will be better understood on reading the following detailed description of a non-limiting illustrative embodiment thereof and on examining the appended drawing, in which:

FIG. 1 is a side view of a spray device according to the invention,

FIG. 2 is a longitudinal section through the dispensing head of the device in FIG. 1, FIG. 3 is a perspective view of the closure cap of the device in FIGS. 1 and 2, FIG. 4 is a longitudinal section of FIG. 3 along IV-IV, FIGS. 5 and 6 are perspective views of the body of the device in FIGS. 1 and 2, FIG. 7 is a longitudinal section through the body in FIGS. 5 and 6, FIGS. 8 and 9 are schematic and partial perspective views of the diffuser in FIGS. 1 and 2, FIG. 10 is a bottom view along the arrow X in FIGS. 8 and 9, FIG. 11 is a longitudinal section along XI-XI in FIGS. 8 to 10, FIG. 12 is a view, similar to FIG. 7, of an alternative embodiment, FIG. 12*a* is a perspective view thereof, FIGS. 12*b* and 12*c* illustrate the functioning of the device in FIGS. 12 and 12*a*, FIGS. 13 and 14 are partial longitudinal sections along XIII-XIII and XIV-XIV, respectively, in FIG. 12, FIG. 15 is a perspective view of the diffuser in FIGS. 12 to 14, FIG. 16 is a view, similar to FIG. 13, of the diffuser on its own, FIG. 17 is a view of the diffuser in FIGS. 12 to 16 along the arrow XVII, FIG. 18 is a side view of the body in FIGS. 12 to 17, FIG. 19 is a view thereof along the arrow XIX, FIG. 20 is a cross-sectional view thereof along XX-XX, FIG. 21 is a cross-sectional view thereof along XXI-XXI, FIG. 22 is a view, similar to FIG. 16, of an alternative embodiment, FIG. 23 is a view thereof along the arrow XXIII, FIGS. 24*a* to 24*g* are views, similar to FIGS. 17 and 19 respectively, of alternative embodiments, FIG. 25 is a view, similar to FIG. 16, of an alternative embodiment, and FIG. 26 is a view thereof along the arrow XXIII in FIG. 25.

FIGS. 1 to 11 show a device 1 for spraying a product, said device 1 comprising a container 2, which contains the product to be sprayed, and a dispensing head 3, which sits on top of the container 2. The initial pressure in the container is, for example, between 1 and 12 bar at 20° C.

The container 2 can comprise a valve holder cup (not shown) crimped onto a body of the container or formed in another way.

The dispensing head 3 comprises a body 5 arranged on the container 2 and cooperating with a diffuser 7. A closure cap 9, visible in FIGS. 3 and 4, is intended to cover the body 5 and the diffuser 7 when the device is not in use. The cap 9 comprises, for example, an annular relief 10 in order to allow it to be held on the container 2 with snap-fit engagement.

The body 5 and the diffuser 7 are configured to allow the product to be sprayed in at least two different directions, which are four in number in the example described and are distributed uniformly about the axis Y of the diffuser. For this purpose, the diffuser 7 comprises four outlet orifices 12, visible in FIGS. 8 to 10, which will be described in detail below.

During the spraying of the product, the flow of product coming from the container firstly passes through a central channel 25 of the body 5, which is intended to allow the product to pass from the container 2 as far as the diffuser 7. This central channel 25 comprises a straight portion 25*a*, which extends in the longitudinal axis X of the device above the container, and an oblique portion 25*b*, which extends along the axis Y of the diffuser γ and which is inclined by an angle γ with respect to the straight portion 25*a*. The angle γ is of the order of 20 to 30°, for example.

The diffuser 7 comprises a central stem 28 allowing it to be fixed to the body 5, in the oblique portion 25*b*. It is fixed by being inserted by force and with snap-fit engagement. For this purpose, the central stem 28 comprises a fixation relief 30, such as an annular bead, intended to snap-fit behind a corresponding relief of the body 5.

The central stem 28 has a shoulder 34 in order to guarantee leaktightness.

Two longitudinal grooves 32 formed on the central stem 28 allow the product to pass from the body 5 towards the diffuser 7. They are diametrically opposite each other in the example described. These grooves 32 are oriented along the axis Y of the diffuser. They can have a cross section that is partially circular.

In the diffuser 7, the flow of product passes through a first inner chamber 15 and a second outer chamber 16 concentric to the first.

The diffuser 7 comprises a separation skirt 18 between the first and second chambers 15 and 16. This separation skirt 18 constitutes an inner wall within the meaning of the invention. It is pierced with two openings 20 to allow the flow of product to pass through. The latter is thus separated into four distinct streams, of which two opposite streams each emerge from the openings 20. The latter are uniformly distributed on the circumference of the separation skirt 18, being diametrically opposite each other. Each opening 20 preferably extends along the entire height $h_1$ of the separation skirt 18, as is illustrated in FIG. 11. The height $h_1$ of the separation skirt 18 is of the order of 2.5 or 4 mm, for example.

The second chamber 16 is surrounded by a peripheral skirt 22 of the diffuser 7, said peripheral skirt 22 cooperating with the body 5 in such a way as to ensure the closure of the second chamber 16. The peripheral skirt 22 comprises the four aforementioned outlet orifices 12 for ensuring the discharge of the product to the outside. These outlet orifices 12 are distributed uniformly about the axis Y of the diffuser 7. They can each extend along the entire height $h_2$ of the peripheral skirt or along only part thereof. This height $h_2$ can be of the order of 1.9 or 5 mm.

The chambers 15 and 16 preferably have respective widths $l_1$ and $l_2$ of the order of 1.2 mm.

The outlet orifices 12 can comprise a lower portion, in the form of a slit of constant width formed in the bottom of the skirt 22, and an upper portion, which has a semicircular cross section and is formed in the top of the skirt 22, extending away from the shoulder 22*a*. The product emerges from the device via the upper portion of the outlet orifices 12, the lower portion being masked and closed by the body 5.

The outlet orifices can each have a cross section of between 0.05 and 5 $mm^2$, preferably between 0.1 and 2 $mm^2$, for example of the order of 1 $mm^2$.

The outlet orifices can have any suitable geometric shape. In one embodiment, they can have a circular cross section.

The outlet orifices 12 are offset angularly with respect to the openings 20 of the separation skirt 18. For example, they are each offset by an angle α of the order of 45°, as is illustrated in FIG. 10.

The openings 20 are offset with respect to the longitudinal grooves 32. For example, they are offset by an angle β of the order of 90°, as is illustrated likewise in FIG. 10.

The body 5 comprises an annular groove 23 intended to receive the peripheral skirt 22 of the diffuser 7. This annular groove 23 is delimited by two concentric ribs 24*a* and 24*b* which are configured to engage on each side of the peripheral skirt 22. The two ribs 24*a* and 24*b* are continuous. They can bear against shoulders 22*a* and 18*a*, which are present on the separation skirt 18 and the peripheral skirt 22 respectively, when the body and the diffuser are assembled. They preferably have respective thicknesses $e_1$ and $e_2$ of the order of 0.7 mm. They form between them a distance d of the order of 1.25 mm. The rib 24*b* closes the lower portion of the outlet orifices 12.

The annular groove 23 and the ribs 24*a* and 24*b* are arranged at an end of the body opposite a mounting skirt 27 for mounting the body 5 on the container 2. The rest of the body, in particular the central channel 25 of the body, is connected to the mounting skirt 27 by a hinge 27*a*. The mounting skirt is preferably fixed with snap-fit engagement on the container, but it can also be fixed to the latter in another way.

The diffuser 7 has an upper face 35 with a generally curved shape, of which the radius of curvature is, for example, between 0 and 20 mm, or between 2 and 10 mm, preferably between 3 and 9 mm, for example of the order of 6 mm.

The upper face 35 of the diffuser 7 has markers in the form of reliefs 36 with the general shape of a triangle, of which the point is oriented towards the edge of the upper face 35 and towards the peripheral skirt 22 in the alignment of the outlet orifices 12. The upper end 35 of the diffuser 7 likewise has a central depression 37, which has a circular contour and accommodates the injection sprue.

The flow of product undergoes at least two changes of direction in the diffuser 7. As is illustrated in FIG. 9, the flow of product thus passes from a first direction A in the grooves 32 to a second direction B in the first chamber 15, the two directions A and B forming between them an angle of 90°. The flow of product then passes from the direction B to a direction C in the second chamber 16, with a change of direction of the order of 180°, then adopts a direction D corresponding to the emergence of the product through an outlet orifice 12.

An alternative embodiment will now be described with reference to FIGS. 12*a* to 12*c* and 12 to 21. In this example, the device comprises a valve with a hollow stem through which the product emerges and which, by being displaced, makes it possible to trigger the dispensing of the product coming from the container. The container 2 can comprise a valve holder cup (not shown) crimped onto a body of the container or formed in another way.

The dispensing head 3 comprises a body 5 arranged on the container 2 and cooperating with a diffuser 7. A closure cap (not shown) is intended to cover the body 5 and the diffuser 7 when the device is not in use. The cap comprises, for example, an annular relief in order to allow it to be held on the container 2 with snap-fit engagement.

The body 5 comprises a movable part 5*a* which is able to pivot with respect to the container 2 so as to trigger the dispensing of product after it has been pivoted through a given angular course.

The movable part 5*a* is connected to a base part 27 mounted fixedly on the container 2. This base part 27 is connected to the movable part by a hinge 27*a* situated, with respect to the longitudinal axis X, on the same side as the inclination of the axis Y, in such a way that the longitudinal axis Y of a cannula 40 of the movable part of the body 5 is substantially parallel to the longitudinal axis X of the container during the dispensing of the product.

The movable part 5*a* thus comprises a dispensing cannula 40 which, at rest, extends along a longitudinal axis Y inclined with respect to the longitudinal axis X of the container by an angle γ, as is illustrated in FIG. 12*b*, which corresponds substantially to said angular course, such that the longitudinal axis Y of the cannula of the movable part 5*a* is substantially parallel to the longitudinal axis X of the container during the dispensing of the product, as is illustrated in FIG. 12*c*. The angular course can be of the order of 13°.

The body 5 and the diffuser 7 are configured to allow the product to be sprayed in at least two different directions, which are four in number in the example described and are distributed uniformly about the axis Y of the diffuser. For this purpose, the diffuser 7 comprises four outlet orifices 12, which will be described in detail below.

During the spraying of the product, the flow of product coming from the container firstly passes through a central channel 25 of the body 5, which is intended to allow the product to pass from the container 2 as far as the diffuser 7. This central channel 25 comprises a straight portion 25*a*, which extends in the longitudinal axis X of the device above the container, and an oblique portion 25*b*, which extends along the axis Y of the diffuser 7 and which is inclined by an angle γ with respect to the straight portion 25*a*. The angle γ is of the order of 10 to 30°, for example.

The movable part 5*a* comprises a stub 41 in which the hollow stem of the valve is engaged, this stub being situated inside a tubular enclosing skirt 42 of the movable part 5*a*. The longitudinal axis X of the container and the longitudinal axis Y of the cannula 40 of the movable part 5*a* are coplanar and intersect substantially at the base of the cannula 40 of the movable part 5*a*.

In addition, the outlet orifices 12 are formed in the diffuser 7 directly. They are formed in a curved portion of the diffuser 7, of hemispherical shape, having a radius of curvature of the order of approximately 6 mm.

The orifices 12 are each oriented outwards on an axis Z, which forms an angle δ with the axis Y of the diffuser. The angle δ is less than 90°, such that the resulting spray is of conical shape, with the product being distributed all around the axis Y. The angle δ can be between 10 and 85°, preferably between 20 and 80°, for example between 30 and 75°, or between 40 and 70°. It can be of the order of 60°, for example.

The dispensing head in FIGS. 12 to 21 also differs from that of FIGS. 1 to 11 in terms of the shape of the body 5. In this illustrative embodiment, the latter comprises a cannula 25*b* through which said channel 25 extends, this cannula having a longitudinal axis Y inclined with respect to the longitudinal axis X of the container.

In addition, the mounting skirt 27 for mounting the body 5 on the container 2 is connected to the rest of the body by a hinge 27*a* situated, with respect to the longitudinal axis X, on the same side as the inclination of the axis Y, in such a way that the longitudinal axis Y of the cannula of a movable part of the body 5 is substantially parallel to the longitudinal axis X of the container during the dispensing of the product.

In the alternative embodiment illustrated in FIGS. 22 and 23, the diffuser 7 has no inner skirt. It has only a single annular chamber 15 through which the flow of product passes before emerging from the outlet orifices 12. The annular chamber 15 comprises inner walls within the meaning of the invention having the form of cylindrical pegs 50.

Other alternative embodiments of an inner wall according to the invention will now be described with reference to FIGS. 24*a* to 24*g*.

Figure 24A:
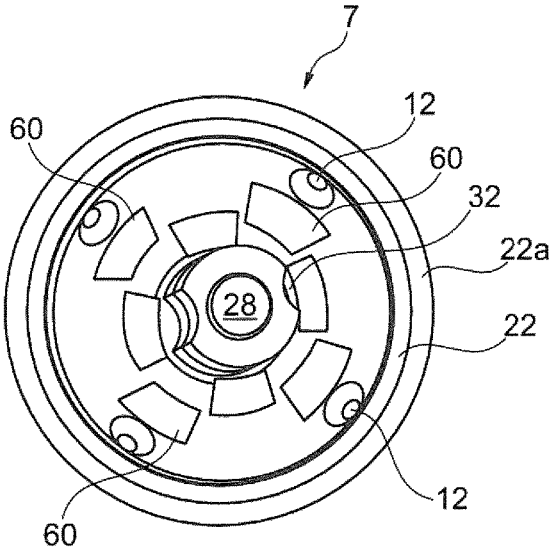
Figure 24B:
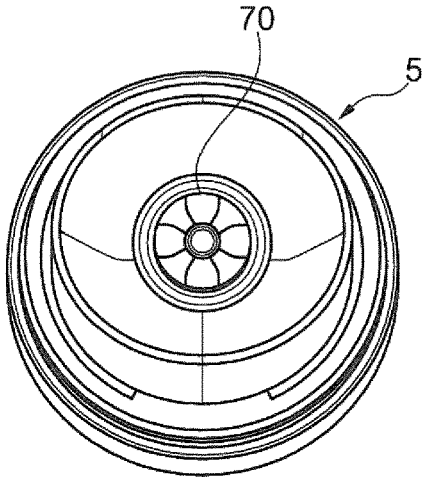
Figure 24C:
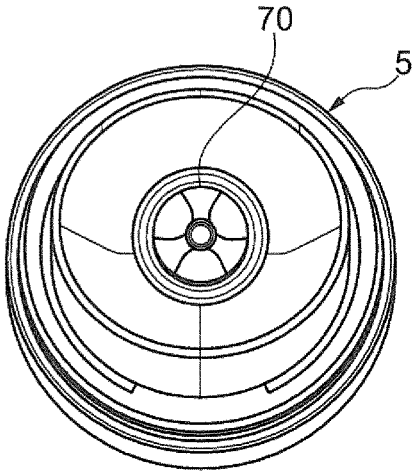
Figure 24D:
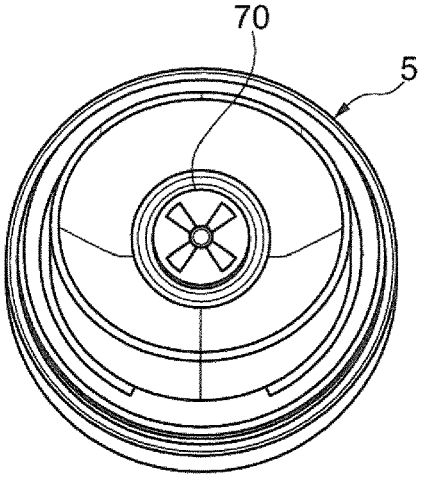
Figure 24E:
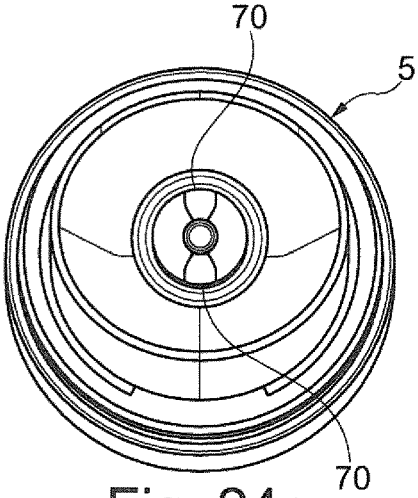
Figure 24F:
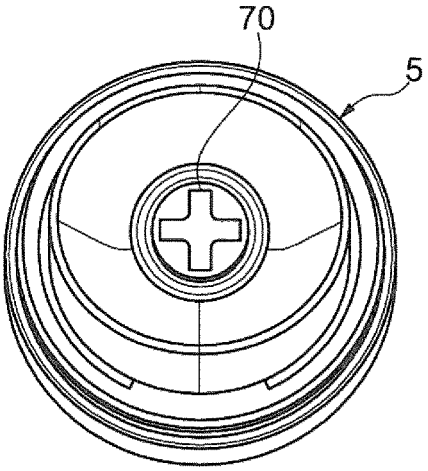
Figure 24G:
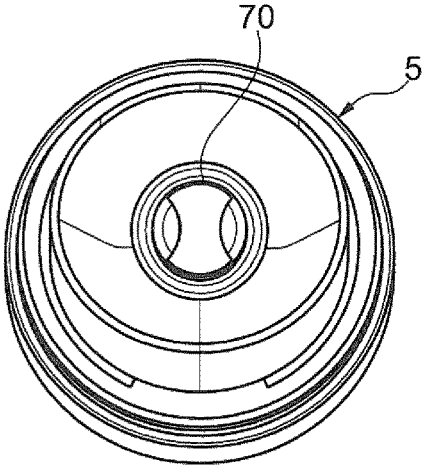

In the variant in FIG. 24*a*, the diffuser 7 comprises inner walls 60 which are partially circular and which are able to split the jet of product issuing from the longitudinal grooves 32.

Alternatively, the jet-splitting inner wall can be formed in the body 5. By way of example, FIGS. 24*b* to 24*g* show a body 5 with at least one closure piece 70 attached to or integrally moulded on the body 5. The closure piece can comprise fins, in particular 2, 3 or 4 fins, which can have edges that are parallel, convergent or divergent. The fins can be connected to one another, via the centre of the body or via their perimeter, or not connected to one another.

In the alternative embodiment illustrated in FIGS. 25 and 26, the diffuser 7 has no inner skirt. It has only a single annular chamber 15 through which the flow of product passes before emerging from the outlet orifices 12.

The invention is not limited to the examples that have just been described.

For example, the valve of the container can be triggered by being pushed down and not by tilting.

The number of outlet orifices can be modified, as can their orientation.

The axes of the outlet orifices, along which axes the sprays are emitted, may or may not be coplanar, or they may or may not be contained in the same cone of axis Y.

It is possible to modify the shape of the body and the manner in which the latter is fixed to the container. It is possible for the body not to be bent, in which case the axis Y of the diffuser then coincides with the longitudinal axis X of the container.

In the example described, the diffuser 7 is mounted on the body 5 without indexing. In one alternative, indexing is used. For this purpose, the diffuser can comprise any suitable means, for example a relief or mark, by which it is possible to ensure the correct positioning of the outlet orifices with respect to the body, in particular with respect to the bearing surface used to trigger the spraying.

When observed from the front, the diffuser can have a contour that is other than circular.

The product to be sprayed may be a deodorant, in particular a deodorant that contains an alcohol, an antiperspirant, a hair-care product, a shaving foam, among other possibilities.

The invention claimed is:

1. Device for spraying a product, said device comprising:
- a container containing the product, and
- a dispensing head comprising a body, and an endpiece, attached to the body,
- the body and the endpiece being configured to allow the product to be sprayed through outlet orifices about a longitudinal axis (Y) of the endpiece, in at least two different directions,
- the dispensing head comprising at least first and second chambers, the first and second chambers being concentric chambers, through which the flow of product successively passes before emerging from the outlet orifices, at least one opening between the first and second concentric chambers being able to be offset angularly with respect to at least one of the outlet orifices,
- the body having two concentric and continuous annular ribs,
- the outlet orifices leading directly to the outside, without an attached nozzle.

2. Device according claim 1, the first and second chambers being at least partially annular.

3. Device according to claim 2, the first at least partially annular chamber extending along the longitudinal axis and being inclined with respect to a longitudinal axis of the device by a non-zero angle.

4. Device according to claim 1, the endpiece comprising a separation skirt which separates the first and second chambers, this separation skirt being pierced with at least two openings allowing the flow of product to pass through.

5. Device according to claim 1, in which the second chamber is surrounded by a peripheral skirt cooperating with the body in such a way as to ensure the closure of the second chamber.

6. Device according to claim 5, in which the body comprises an annular groove intended to receive the peripheral skirt of the endpiece.

7. Device according to claim 1, in which the endpiece, has an upper face of a generally curved shape with an outward convexity.

8. Device according to claim 1, in which the body comprises a central channel intended to allow the flow of product to pass from the container to the endpiece.

9. Device according to claim 1, in which the endpiece, comprises a stem allowing it to be fixed to the body.

10. Device according to claim 9, the stem having a harpoon shape.

11. Device according to claim 9, the stem comprising at least one longitudinal groove allowing the product to pass from the body towards the endpiece.

12. Device according to claim 1, the flow emerging from an outlet orifice being oriented non-parallel to the longitudinal axis (X) of the device.

13. Device according to claim 1, in which a peripheral skirt of the endpiece, in which skirt the outlet orifices are formed, engages between the two concentric and continuous annular ribs.

14. Device according to claim 1, the outlet orifices having axes which are coplanar.

15. Device according to claim 1, wherein the endpiece is a diffuser.

16. Device according to claim 1, at least one opening between the first and second concentric chambers being offset angularly with respect to at least one of the outlet orifices.

17. Device for spraying a product, said device comprising:
- a container containing the product, and
- a dispensing head comprising a body, and an endpiece including a diffuser, attached to the body,
- the endpiece comprising a stem allowing it to be fixed to the body,
- the body and the endpiece being configured to allow the product to be sprayed through outlet orifices about a longitudinal axis of the endpiece, in at least two different directions,
- the dispensing head comprising at least first and second concentric chambers, through which the flow of product successively passes before emerging from the outlet orifices, at least one opening between the first and second concentric chambers being able to be offset angularly with respect to at least one of the outlet orifices,
- the body having a central channel intended to allow the flow of product to pass from the container to the endpiece and two concentric and continuous annular ribs.

18. Device according to claim 17, wherein the stem allows the endpiece to be fixed to the body with snap-fit engagement.

19. Device for spraying a product, said device comprising:
- a container containing the product, and
- a dispensing head comprising a body, and an endpiece including a diffuser, attached to the body,
- the endpiece comprising a stem allowing it to be fixed to the body,
- the body and the endpiece being configured to allow the product to be sprayed through outlet orifices about a longitudinal axis of the endpiece, in at least two different directions, the dispensing head comprising at least first and second concentric chambers, through which the flow of product successively passes before emerging from the outlet orifices, at least one opening between the first and second concentric chambers being able to be offset angularly with respect to at least one of the outlet orifices, the body having a central channel intended to allow the flow of product to pass from the container to the endpiece and two concentric and continuous annular ribs, the stem comprising at least two longitudinal grooves allowing the product to pass from the body towards the endpiece, wherein the at least two longitudinal grooves include a partially circular cross section.

20. Device according to claim 17, wherein the stem is configured to be insertable into the central channel.

* * * * *